US006121143A

United States Patent [19]

Messner et al.

[11] Patent Number: 6,121,143

[45] Date of Patent: Sep. 19, 2000

[54] ABRASIVE ARTICLES COMPRISING A FLUOROCHEMICAL AGENT FOR WAFER SURFACE MODIFICATION

[75] Inventors: Robert P. Messner; Carl R. Kessel, both of St. Paul; George G. Moore, Afton, all of Minn.

[73] Assignee: 3M Innovative Properties Company, St. Paul, Minn.

[21] Appl. No.: 08/933,870

[22] Filed: Sep. 19, 1997

[51] Int. Cl.[7] ..... H01L 21/302

[52] U.S. Cl. ..... 438/692; 51/295; 156/345; 428/145; 428/409; 428/447; 437/225; 437/946; 437/974; 451/530

[58] Field of Search ..... 156/345; 51/295; 428/145, 409, 447; 437/225, 946, 974; 438/692; 451/530

[56] References Cited

U.S. PATENT DOCUMENTS

| | | |
|---|---|---|
| 2,050,992 | 8/1936 | Aust . |
| 2,278,158 | 3/1942 | Ware . |
| 2,642,416 | 6/1953 | Ahlbrecht et al. . |
| 2,768,886 | 10/1956 | Twombly . |
| 2,780,534 | 2/1957 | Kuzmick et al. . |
| 2,882,064 | 4/1959 | Morrison . |
| 2,893,854 | 7/1959 | Rinker et al. . |
| 3,042,508 | 7/1962 | Haigis et al. . |
| 3,043,673 | 7/1962 | Klein et al. . |
| 3,089,763 | 5/1963 | Gladstone . |
| 3,188,265 | 6/1965 | Charbonneau et al. . |

(List continued on next page.)

FOREIGN PATENT DOCUMENTS

| | | |
|---|---|---|
| 0 291 100 A2 | 11/1988 | European Pat. Off. . |
| 0 554 668 A1 | 8/1993 | European Pat. Off. . |
| 0 811 666 A2 | 12/1997 | European Pat. Off. . |
| 71032912 | 5/1969 | Japan . |
| 46-32912 | 9/1971 | Japan . |
| 53073067 | 6/1978 | Japan . |
| 56069074 | 6/1981 | Japan . |
| 58211860 | 12/1983 | Japan . |
| 5032959A | 2/1993 | Japan . |
| 7-263385 | 10/1995 | Japan . |
| 2 136 011 | 9/1984 | United Kingdom . |
| WO 93/12911 | 7/1993 | WIPO . |
| WO 94/04599 | 3/1994 | WIPO . |
| WO 95/07797 | 3/1995 | WIPO . |
| WO 95/19242 | 7/1995 | WIPO . |
| WO 95/22436 | 8/1995 | WIPO . |
| WO 97/11484 | 3/1997 | WIPO . |

OTHER PUBLICATIONS

Chemical–Mechanical Polishing Workshop, "Booklet of Presentations", Aug. 3–6, 1997.

Tonshoff et al, "Abrasive Machining of Silicon", Annals of the CIRP, vol. 39/2/1990, pp. 621–635.

Renard et al., "An innovative bond system extends the utility of CBN (cubic boron nitride) abrasive", Ind. Diamond Rev., May 1978, pp. 163–165 (Abstract Only).

Tucker, "Chemical Mechanical Planarization Technology—Intellectual Property Issues", Semiconductor Fabtech, 6th Edition, pp. 301–310.

Perettie et al, "Perfluorocyclobutane containing aromatic ether polymers as planarization materials for alternative magnetic media substrates", J. Appl. Phys. 76 (10, Nov. 15, 1994, pp. 6579–6581.

*Primary Examiner*—Robert Dawson
*Assistant Examiner*—Jeffrey B. Robertson
*Attorney, Agent, or Firm*—Daniel R. Pastirik

[57] ABSTRACT

This invention relates to fixed abrasive articles and abrasive constructions containing at least one fluorochemical agent. The fixed abrasive articles and abrasive constructions are used in semiconductor wafer surface modification processes during the fabrication of semiconductor devices. Specifically, fixed abrasive articles comprise an abrasive composite that is coextensive with a backing and at least one fluorochemical agent associated with the composite. The invention further relates to methods of making fixed abrasive articles comprising at least one fluorochemical agent.

28 Claims, 2 Drawing Sheets

U.S. PATENT DOCUMENTS 3,594,865 7/1971 Erb .
3,605,349 9/1971 Anthon .
3,779,727 12/1973 Siqui et al. .
3,795,496 3/1974 Greenwood .
3,868,232 2/1975 Sioui et al. .
3,868,233 2/1975 Carver et al. .
3,869,834 3/1975 Mullin et al. .
3,997,302 12/1976 Supkis .
4,255,164 3/1981 Butzke et al. .
4,343,628 8/1982 Taylor .
4,563,388 1/1986 Bonk et al. .
4,609,581 9/1986 Ott .
4,652,274 3/1987 Boettcher et al. .
4,720,941 1/1988 Bellieff et al. .
4,728,552 3/1988 Jensen, Jr. .
4,735,632 4/1988 Oxman et al. .
4,749,617 6/1988 Canty .
4,751,138 6/1988 Tumey et al. .
4,773,920 9/1988 Chasman et al. .
4,786,546 11/1988 Vassiliou .
4,903,440 2/1990 Larson et al. .
4,906,523 3/1990 Bilkadi et al. .
4,933,234 6/1990 Kobe et al. .
4,950,696 8/1990 Palazotto et al. .
4,954,141 9/1990 Takiyama et al. .
4,954,459 9/1990 Avanzino et al. .
4,959,265 9/1990 Wood et al. .
4,985,340 1/1991 Palzaaotto et al. .
5,014,468 5/1991 Ravipati et al. .
5,015,266 5/1991 Yamamoto .
5,077,870 1/1992 Melbye et al. .
5,141,790 8/1992 Calhoun et al. .
5,152,917 10/1992 Pieper et al. .
5,164,265 11/1992 Stubbs .
5,178,646 1/1993 Barber, Jr. et al. .
5,219,462 6/1993 Bruxvoort et al. .
5,236,472 8/1993 Kirk et al. .
5,254,194 10/1993 Ott et al. .
5,256,170 10/1993 Harmer et al. .
5,257,478 11/1993 Hyde et al. .
5,266,525 11/1993 Morozumi .
5,274,159 12/1993 Pellerite et al. .
5,304,223 4/1994 Pieper et al. .
5,341,609 8/1994 Gorsuch et al. .
5,378,252 1/1995 Follensbee .
5,417,726 5/1995 Stout et al. .
5,435,816 7/1995 Spurgeon et al. .
5,437,754 8/1995 Calhoun .
5,441,659 8/1995 Minor .
5,454,844 10/1995 Hibbard et al. .
5,478,436 12/1995 Winebarger et al. .
5,489,235 2/1996 Gagliardi et al. .
5,505,747 4/1996 Chesley et al. .
5,527,415 6/1996 Doyle et al. .
5,573,444 11/1996 Ryoke et al. .
5,578,362 11/1996 Reinhardt et al. ..... 428/147
5,607,341 3/1997 Leach .
5,616,212 4/1997 Isobe .
5,958,794 9/1999 Bruxvoort et al. ..... 438/692

ABRASIVE ARTICLES COMPRISING A FLUOROCHEMICAL AGENT FOR WAFER SURFACE MODIFICATION

BACKGROUND

This invention relates to methods of modifying the surface of semiconductor wafers during semiconductor wafer fabrication and fixed abrasive articles used in such surface modification processes. The fixed abrasive articles have an exposed major surface comprising an abrasive composite, or composites, coextensive with a backing. The abrasive composites of fixed abrasive articles comprise abrasive particles dispersed throughout a binder.

Integrated circuits are very small, complex electrical components that have multiple metal interconnect layers coupled to a vast number of electrical elements within a very small unit of area. Each layer of an integrated circuit typically has a specific pattern of metal interconnects responsible for the specific characteristics of a particular integrated circuit. To create these patterns of metal interconnects, manufacturers of integrated circuits typically use a precise multi-step fabrication process, One of the starting materials of integrated circuit manufacture is a semiconductor wafer. Typically, semiconductor wafers undergo processing steps, including deposition, patterning, and etching during the semiconductor wafer fabrication process. Details of these manufacturing steps for semiconductor wafers are reported by Tonshoff et al., "Abrasive Machining Of Silicon", published in the *Annals of the International Institution for Production Engineering Research,* (Volume 39/2/1990), pp. 621–635). In a sequence of manufacturing steps, it is often desirable to modify or refine an exposed surface of the wafer in order to prepare the wafer for subsequent fabrication or manufacturing. The surface modification process typically is a form of polishing wherein the process is able to remove cumulative irregularities from the surface in a quick and efficient manner without damaging functional components during the process.

One specific type of wafer surface modification process utilizes slurries of abrasive particles often in conjunction with chemical additives and resilient pads, to planarize the surface of a wafer at various steps during the fabrication of the device. This combination of surface modifying chemical additives and mechanical processing is broadly referred to as chemical mechanical planarization or CMP. Alternatively, CMW may employ a three-dimensional, textured, fixed abrasive articles. Such abrasive articles typically have a precisely shaped composite array that is coextensive with a backing. These fixed abrasive articles have been described in WO-97/11484 and in copending U.S. Ser. No. 08/694,014 (Bruxvoort), now U.S. Pat. No. 5,958,794, incorporated herein by reference. The methods described within these references employ a three dimensional, textured, fixed abrasive article and a working fluid, which may be substantially free of abrasive particles and is able to modify the semiconductor wafer surface.

Typically, CMP is tailored for efficient removal of a particular material from a semiconductor wafer surface. For example, dielectric materials such as polycrystalline silicon, thermal oxide, doped and undoped oxides are commonly applied to the surface of a semiconductor wafer. For a particular surface material such as silicon dioxide, a CMP process comprising a particular working solution that optimizes silicon dioxide removal may be employed. It is also common for metals, such as tungsten, aluminum, copper, gold, silver, to be deposited onto the surface of a semiconductor wafer and one skilled in the art would choose a specific CMP process for the removal of a particular metal(s) on the wafer surface. Other materials processed using CMP methods include silicon nitride, boron nitride, diamond-like carbon films, polyimides, spin-on polymers, aerogels, refractory oxides and suicides, and ferroelectrics.

A particular CMP process may be assigned a removal rate, usually measured in Angstroms per minute, equivalent to the removal of a portion of a layer from a semiconductor wafer surface in a given time period. A CMP process having a high removal rate is advantageous because there may be a large total number of steps required during the semiconductor wafer fabrication process. By decreasing the length of time it takes to complete some of these steps, manufacturers will be able to increase the rate of integrated circuit manufacture. In addition to a high removal rate, it is desirable that a CMP process uniformly remove material parallel to the surface of the wafer to be modified. Uniform removal of material will avoid leaving some regions unmodified and other regions over-modified with the possible destruction of previously created features of an underlying layer, such as metal interconnects.

It is also preferred that a CMP process have a high removal rate stability. Removal rate stability may be defined as the consistent removal of surface material (usually measured in Angstroms per minute) among the wafers modified by the process. For example, a particular CMP process will have high removal rate stability if the rate of removal of surface from the first wafer modified by the CMP process is nearly identical to the rate of removal of the surface of the tenth or twentieth wafer modified by the process. Removal rate stability is an important consideration because difficulties exist in monitoring the removal of the wafer surface during the modification process while controlling the amount of surface material removed per wafer. A CMP process with a high removal rate stability would ensure that subsequent identical semiconductor wafers modified by the process will have nearly identical amounts of surface material removed and minimize the need for on-line metrology or frequent off-line confirmation of anticipated removal rate.

SUMMARY OF THE INVENTION

One embodiment of the present invention is a fixed abrasive article that, in addition to having an abrasive composite generally coextensive with a backing, also includes at least one fluorochemical agent associated with the fixed abrasive article. Such an article used in CMP results in processes having enhanced removal rates that can quickly and precisely modify the surface of a semiconductor wafer without disrupting the delicate components on the wafer surface. The addition of at least one fluorochemical agent to a fixed abrasive article used in CMP processes increases the wafer surface removal rates of the processes and also minimizes the noise level created by such processes. The fluorochemical agent associated with the fixed abrasive article may provide other beneficial characteristics to CMP processes.

Specifically, the invention embodies a fixed abrasive article comprising an exposed major surface made of an abrasive composite that includes a plurality of abrasive particles fixed and dispersed in a binder. Commonly only one surface of the fixed abrasive article comes in contact with the wafer surface to be modified and this surface of the fixed abrasive article is frequently called the "exposed major surface". Typically, the abrasive composite has a precisely shaped three dimensional structure. At least one fluorochemical agent is associated with the fixed abrasive article and enhances the removal rate of a CMP process. In addition, the fluorochemical agent may be associated with primarily one component of an abrasive composite or more than one component of an abrasive composite. The components of an abrasive composite include, but are not limited to, abrasive particles, binder, or the exposed outer surface of the abrasive composite. Examples of an article of the present invention includes a fixed abrasive article having at least one fluorochemical agent associated with at least the abrasive particles. Another example includes at least one fluorochemical agent associated at least with the binder. Still another example includes at least one fluorochemical agent associated at least with the exposed major surface of the abrasive composite. Alternatively, a fixed abrasive article may include an abrasive composite that, in addition to the abrasive particles and binder, further comprises a filler that includes at least one fluorochemical agent associated with at least the filler.

Another embodiment of the invention is a method of modifying an exposed surface of a semiconductor wafer. The method requires contacting a major surface of a semiconductor wafer with the exposed major surface of a fixed abrasive article, wherein the surface of the fixed abrasive article comprises an abrasive composite.

The abrasive composite typically is textured, having a three dimensional structure and comprises a plurality of abrasive particles fixed and dispersed in a binder with at least one fluorochemical agent associated with at least one component of the fixed abrasive article in a manner which allows the fluorochemical agent to be present at the exposed major surface of the fixed abrasive article during processing. The method includes the steps of contacting the surface of the wafer to be modified with the exposed major surface of the fixed abrasive article and moving the wafer relative to the fixed abrasive article while maintaining contact and sufficient pressure between the wafer and the fixed abrasive article thereby modifying the surface of the wafer. The method commonly includes the use of a working fluid which optionally supplies reactive components, transports heat into or out of the interface, and assists in the removal of debris generated by the polishing process.

In another aspect, the invention embodies a semiconductor wafer produced from the aforementioned method.

Other features, advantages, and constructs of the invention will be better understood from the following description of figures and the preferred embodiments of the present invention.

DETAILED DESCRIPTION OF THE INVENTION

Use of fluorochemicals in abrasive modification processes is not widely reported. U.S. Pat. No. 5,164,265 (Stubbs) reports the addition of a fluorochemical to the layers of abrasive elements (containing a "make" and a "size" coat) minimizes problems associated with "loading". Loading occurs when abrading soft materials, because the soft material released from the surface clogs the abrasive material of the abrasive element. Stubbs reports this loading phenomenon is a particular problem when cellulose-based paints are involved, especially nitrocellulose paints which are commonly used on car bodies. The process of removing paint from cars is unlike the process of CMP in that the semiconductor wafer may contain electrical components that can be easily disrupted by the process. U.S. Pat. No. 5,578,362 (Reinhardt) reports that fluorochemical hydrocarbons may be a constituent of a pad for use with conventional slurry CMP processes. The fluorochemical hydrocarbon is just one of many possible alternative constituents of a pad. The reference does not report that such fluorochemical hydrocarbons actually improve the removal rate of a CMP process or minimizes the noise associated with a CMP process.

One embodiment of the invention is a fixed abrasive article comprising at least one fluorochemical agent used in surface modification processes during semiconductor device fabrication. These fixed abrasive articles have multiple components that are individually important to the wafer surface modification process. The components of the abrasive article and other embodiments of the invention are discussed in the following sections of the patent application.

Fixed Abrasive Article

Figure 1:
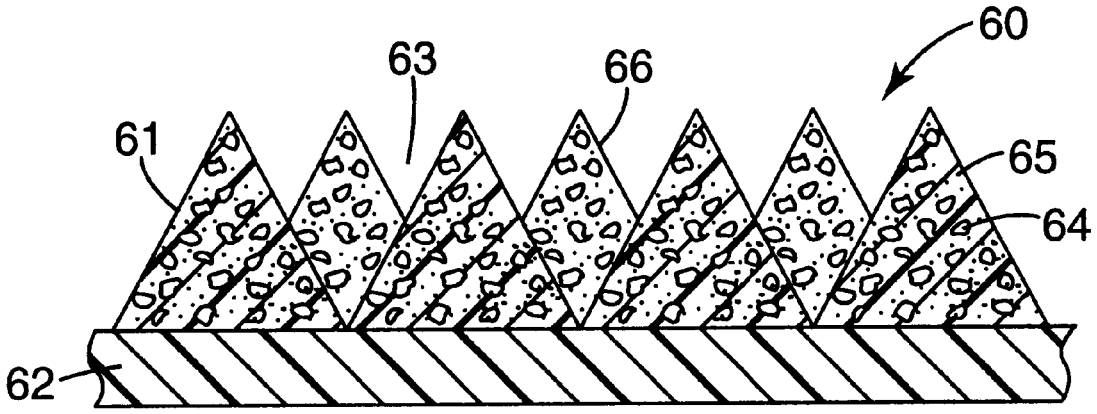
FIG. 1 is a cross sectional view of a portion of a first fixed abrasive article.

The fixed abrasive article of the present invention typically comprises an abrasive composite layer coextensive with a single backing or a multilayer backing. The abrasive composite may form structures, or abrasive composites, that provide a textured surface to a fixed abrasive article. An example of a textured fixed abrasive article is illustrated in FIG. 1. Specifically, FIG. 1 illustrates a fixed abrasive article 60 with pyramidal abrasive composites 61 fixed or bonded to a backing 62. The abrasive composite (structures) 61 comprises abrasive particles 64 dispersed within a binder 65. There are recesses or valleys 63 between adjacent abrasive composites. A fixed abrasive article may have at least one fluorochemical agents associated primarily with its binder 65. Alternatively, a fixed abrasive article may have one or more fluorochemical agents associated primarily with its abrasive particles 64. Another alternative is a fixed abrasive article that may have one or more fluorochemical agents associated primarily with its surface 66. Alternatively, a fixed abrasive article may have a fluorochemical agent associated with all aforementioned components of its abrasive composite or in any combination thereof Components of an abrasive composite refer to the binder, abrasive particles, the abrasive composite surface, and/or other components. The term "associated with" refers to attachment to, bonding to, or permeation throughout an element of an abrasive composite by the fluorochemical agent. A fluorochemical agent initially applied to or incorporated within a particular element of an abrasive article may subsequently diffuse or otherwise be transported to or throughout another element of the article. For example, a fluorochemical oil which was initially applied to the surface of the abrasive article may diffuse into the binder upon storage or during the surface modification process.

The fluorochemical agents of the fixed abrasive article may be "reactive" in that the fluorochemical is involved in a polymerization reaction or other chemical reaction, unlike an "unreactive" fluorochemical agent. Most preferably, the fluorochemical agent is a liquid or solid organofluorochemical. Suitable reactive fluorochemical agents include, but are not limited to, fluorochemical methacrylates; and fluorochemical acrylates, for example $C_8F_{17}SO_2N(C_2H_5)C_2H_4OCOCH{=}CH_2$, $C_8F_{17}SO_2N(CH_3)C_2H_4OCOCH{=}CH_2$, $C_8F_{17}SO_2N(C_2H_4OCOCH{=}CH_2)_2$; $C_7F_{15}CH_2OCOC(CH_3){=}CH_2$, $C_nF_{2n+1}C_2H_4OCOCH{=}CH_2$ (n=5–12); cyclo-$C_6F_{11}OCOCH{=}CH_2$, $C_9F_{17}OC_2H_4OCOCH{=}CH_2$ (derived from hexafluoropropylene trimer), $C_nF_{2n+1}O(C_2F_4O)_mCF_2CH_2OCOCH{=}CH_2$ (n=1 to 6, m=2 to 20); fluorochemical epoxies for example,

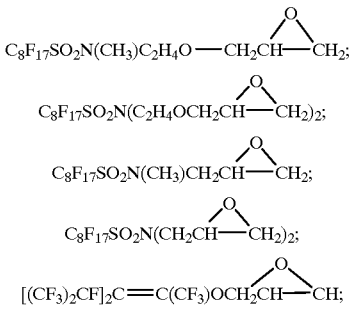

fluorochemical silanes for example, $C_8F_{17}SO_2N(C_2H_5)CH_2CH_2CH_2Si(OCH_3)_3$; fluorochemical isocyanates for example, $C_8F_{17}SO_2N(CH_3)C_2H_4NCO$ and $C_nF_{2n+1}C_2H_4NCO$; fluorochemical carboxylic acids for example, $C_8F_{17}SO_2N(C_2H_5)CH_2COOH$, $C_7F_{15}COOH$, $C_nF_{2n+1}O(C_2F_4O)_mCF_2COOH$ (n=1 to 6, m=2 to 20), $HOCOCF_2O(C_2F_4O)_mCF_2COOH$ (m=2 to 20) and their salts and amides; fluorochemical sulfonic acids for example $C_8F_{17}SO_3H$ and their salts and amides; fluorochemical phosphate esters for example $(C_8F_{17}SO_2N(C_2H_5)C_2H_4O)PO(OH)_{3n}$(n=1 or 2); fluorochemical alcohols for example $C_7F_{15}CH_2OH$, $C_nF_{2n+1}C_2H_4OH$, $HOCH_2(C_2F_4O)_p(CF_2O)_qCF_2CH_2OH$ ($M_N$= 2000).

Examples of specific unreactive fluorochemical agents include fluorochemical polyether oils for example "FOMBLIN" manufactured by Ausimont, "KRYTOX" manufactured by E.I. DuPont, $C_nF_{2n+1}O(C_2F_4O)_xO(C_2F_4O)_xOC_nF_{2n+1}$ (n=1–8, x—6–20), or $C_nF_{2n+1}O(C_4F_8O)_xOC_nF_{2n+1}$ (n=1–8, x=3–20); fluorochemical alkane waxes for example $C_{16}F_{34}$; fluorochemical ethers for example $C_8F_{17}OC_8F_{17}$ and $C_7F_{15}CH_2OC_8H_{17}$; fluorochemical esters; fluorochemical urethanes; fluorochemical amides for example $C_7F_{15}CON(C_4H_9)_2$ and $C_8F_{17}SO_2N(C_4H_9)_2$; fluorochemical thermoplastics for example TEFLON manufactured by DuPont or KEL-F manufactured by Daikin America, Orangeberg, N.Y.; fluorochemical thermoplastic copolymers such as those disclosed in U.S. Pat. Nos. 389,625 and 2,642,416 incorporated herein by reference, and fluorochemical elastomers for example copolymers of hexafluoropropylene and vinylidene fluoride. The fluorochemical agents were chosen for their ability to become part of a fixed abrasive article and for their ability to increase removal rate when a fixed abrasive article was used in a wafer surface modification procedure. Fluorochemicals are associated with a variety of properties of potential relevance to the present use, including low surface energy, easy removal of detritus, low coefficient of friction, and lubricity. Preferably, the fluorochemical agent associated with a component of a fixed abrasive article includes at least 25 ppm of the fluorochemical agent up to 10% of the abrasive composite. Most preferably, the fluorochemical agent associated with a component of a fixed abrasive article includes at least 25 ppm of the fluorochemical agent up to 5% of the abrasive composite.

Very small features, often less than one micron wide, are associated with fabricated structures on the surface of semiconductor wafers so that articles used in wafer surface modification processes must be amiable to the surface of the wafer. The fixed abrasive articles of the present invention used in a CMP process, provide a quick and precise modification of semiconductor wafer surfaces without disrupting specific metal interconnect structures or other functional features on the wafer surface. It has been found that the removal rates of surface modification processes using fixed abrasive articles of the invention are generally higher than removal rates of surface modification processes utilizing similar fixed abrasive articles free of fluorochemical agents. As mentioned, wafer surface modification processes having high material removal rates are advantageous in that they allow increased rates of integrated circuit manufacture.

CMP processes using a fixed abrasive article free of a fluorochemical agent may create high noise levels. Unexpectedly, when a fixed abrasive article comprises at least one fluorochemical agent is used in CMP, the sound or noise created by the process is minimized. The difference in noise heard is substantial in that the machine operator is easily able to detect the difference in volume as opposed to pitch or tone between the two processes without the use of electronic measuring devices or like devices for measuring small differences in sound.

The fixed abrasive article of the invention is preferably circular in shape, e.g., in the form of an abrasive disc. The outer edges of the circular abrasive disc are preferably smooth or, alternatively, may be scalloped. The fixed abrasive article may also be in the form of an oval or of any polygonal shape such as triangular, square, rectangular, and the like. Alternatively, the fixed abrasive article may be in the form of a belt in another embodiment. The fixed abrasive article may be provided in the form of a roll, typically referred to in the abrasive art as abrasive tape rolls. In general, the abrasive tape rolls will be indexed during the wafer modification process. The fixed abrasive article may be perforated to provide openings through the abrasive coating and/or the backing to permit the passage of the liquid medium before, during or after use. Additional details concerning the general characteristics of the fixed abrasive article and its method of manufacture can be found in U.S. Ser. No. 08/694,014 (Bruxvoort), now U.S. Pat. No. 5,958,794.

Generally, a fixed abrasive article comprising a fluorochemical agent is preferably long lasting in that it should be able to complete at least 2, preferably at least 5, more preferably at least 20 and most preferably at least 200 wafer surface modifications. In addition to long lasting performance, the fixed abrasive article generally has a higher removal rate than fixed abrasive articles free of fluorochemical agents. The increase in removal rate does not appear to interfere with the precision of the Cow process since the fixed abrasive article is capable of yielding semiconductor wafers having acceptable flatness, surface finish and minimal dishing and doming. The materials, desired texture, and process used to make the fixed abrasive article will influence the CMP process.

Specific elements of the fixed abrasive article are also described in U.S. Pat. No. 5,152,917 (Pieper et al.) and U.S. Ser. No. 08/694,014 (Bruxvoort), now U.S. Pat. No. 5,958,794, as incorporated herein by reference.

Abrasive Particles

An abrasive composite of a fixed abrasive article comprises a plurality of abrasive particles dispersed in a binder. The abrasive particles may be non-homogeneously dispersed in a binder but it is generally preferred that the abrasive particles are homogeneously dispersed in the binder. The abrasive particles may be associated with at least one fluorochemical agent. The fluorochemical agent may be applied to the surface of the abrasive particles by mixing the particles in a fluid containing one or more fluorochemical agents, or by spraying the one or more fluorochemical agents on to the particles. The fluorochemical agents associated with abrasive particles may be reactive or unreactive.

Fine abrasive particles are preferred for the construction of a fixed abrasive article used to modify or refine wafer surfaces. The average size of the abrasive particles can range from about 0.001 to 50 micrometers, typically between 0.01 to 10 micrometers. In some instances the average particle is about 5.0 micrometers or even about 0.3 micrometers. In some instances the average particle is about 0.5 micrometers or even about 0.3 micrometers. The size of the abrasive particle is typically specified to be the longest dimension of the abrasive particle. In almost all cases there will be a range or distribution of particle sizes. In some instances it is preferred that the particle size distribution be tightly controlled such that the resulting fixed abrasive article provides a consistent surface finish on the wafer. The abrasive particles may also be present in the form of an abrasive agglomerate. The abrasive particles in each agglomeration may be held together by an agglomerate binder. Alternatively, the abrasive particles may bond together by inter particle attraction forces.

Examples of suitable abrasive particles include fused aluminum oxide, heat treated aluminum oxide, white fused aluminum oxide, porous aluminas, transition aluminas, zirconia, tin oxide, ceria, fused alumina zirconia, or alumina-based sol gel derived abrasive particles. The alumina abrasive particle may contain a metal oxide modifier. The particular abrasive particles or mixture of particles chosen will depend on the type of wafer surfaces to be modified. The wafer surfaces to be processed can include interlayer dielectric materials, metals or organic polymeric materials such as polyimide. Examples of interlayer dielectric materials commonly modified using CMP processes include silicon dioxide and silicon dioxide which is doped with boron and/or phosphorous. An additional type of interlayer dielectric material is a silicon dioxide into which fluoride has been introduced during deposition. Examples of metals which are commonly modified using CMP processes include gold, silver, tungsten, aluminum, copper and mixtures and alloys thereof.

The ceria abrasive particles often used in such articles may either be essentially free of modifiers or dopants (e.g., other metal oxides) or may contain modifiers and/or dopants (e.g., other metal oxides). In some instances, these metal oxides may react with ceria. It is also feasible to use ceria with a combination of two or more metal oxide modifiers. These metal oxides may react with the ceria to form reaction products.

The fixed abrasive article may also contain a mixture of two or more different types of abrasive particles. The abrasive particles may be of different hardnesses. In the mixture of two or more different abrasive particles, the individual abrasive particles may have the same average particle size, or may have a different average particle size.

In some instances it is preferred to modify or treat the surface of the abrasive particles with a surface modification additive. These additives may improve the dispersibility of the abrasive particles in the binder precursor and/or improve the adhesion to the binder precursor and/or the binder. Abrasive particle treatment may also alter and improve the cutting characteristics of the treated abrasive particles. Further treatment may also substantially lower the viscosity of the uncured abrasive composite. The lower viscosity also permits higher percentages of abrasive particles to be incorporated into an uncured abrasive composite. Another potential advantage of a surface treatment is to minimize the unintentional agglomeration of the abrasive particles. Examples of suitable surface modification agents include silanes, phosphonates, titanates, and zircoaluminates. Examples of commercially available silane surface modification agents include "A174" and "A1230" from OSi Specialties, Inc., Danbury, Conn. An example of a surface modification agents for ceria abrasive particles is isopropyl triisosteroyltitanate. Other examples of commercial surface modification agents are Disperbyk 111 available from Byk Chemie, Wallingford, Conn. and FP4 available from ICI America Inc., Wilmington, Del.

Filler Particles

A filler is a component of a fixed abrasive article for the purposes of modifying the erodibility of the abrasive composite. In some instances, with the appropriate and correct amount of filler, the erodibility of the abrasive composite may decrease. Conversely, in some instances with the appropriate and correct amount of filler, the erodibility of the abrasive composite may increase. Fillers may also be selected to reduce cost of the abrasive composite, alter the rheology of the slurry, and/or to alter the abrading characteristics of the abrasive composite. Fillers are typically selected so as not to deleteriously affect the desired modification criteria. Examples of useful fillers for this invention include alumina trihydrates, magnesium silicate, thermoplastic particles and thermoset particles. Other miscellaneous fillers include inorganic salts, sulfur, organic sulfur compounds, graphite, boron nitride, and metallic sulfides. These examples of fillers are meant to be a representative showing of some useful fillers, and are not meant to encompass all useful fillers. In some instances, it is preferable to use a blend of two or more different particle sizes of filler. Fillers may be provided with a surface treatment as described above for abrasive particles. The fillers should not cause excessive scratching of the exposed wafer surface.

Suitable filler particles may be associated with at least one fluorochemical agent. The fluorochemical agent may be applied to the surface of the filler by mixing the filler in a solution of at least one fluorochemical agent or spraying at least one fluorochemical agent on to the surface of the filler. The fluorochemical agent associated with a filler may be reactive or unreactive. The filler could also be made of a fluorochemical material such as a fluorochemical thermoplastic particles such as polytetrafluoroethylene.

Binders

The particular chemistry of the binder is important to the performance of the fixed abrasive article. For example, if the binder is "too hard", the resulting fixed abrasive article may create deep and unacceptable scratches in the exposed surface. Conversely, if the binder is "too soft", the resulting fixed abrasive article may not provide a sufficient removal rate during the modification process or may have poor article durability. Thus, the binder is selected to provide the desired characteristics of the fixed abrasive article.

The binders of fixed abrasive articles of this invention are preferably formed from an organic binder precursor. The binder precursor preferably is capable of flowing sufficiently so as to be able to coat a surface. Solidification of the binder precursor may be achieved by curing (e.g., polymerizing and/or cross-linking), by drying (e.g., driving off a liquid), and/or simply by cooling. The binder precursor may be an organic solvent-borne, a water-borne, or a 100% solids (i.e., a substantially solvent-free) composition. Both thermoplastic and thermosetting polymers or materials, as well as combinations thereof, may be used as the binder precursor.

One or more fluorochemical agents may be mixed with an organic binder precursor before solidification. A reactive fluorochemical agent may actually be a component of the polymerization process of the binder so that when the binder solidifies, it may be incorporated into the polymeric structure of the binder. Examples of reactive fluorochemical agents include but are not limited to fluorochemical acrylates and methacrylates. Alternatively, at least one fluorochemical agent may be applied to the binder after it is solidified.

In many instances, the abrasive composite is formed from a slurry of a mixture of abrasive particles and a binder precursor. The abrasive composite may comprise by weight between about 1 part abrasive particles to 95 parts abrasive particles and 5 parts binder to 99 parts binder. Preferably the abrasive composite comprises about 30 to 85 parts abrasive particles and about 15 to 70 parts binder. Likewise the abrasive composite may comprise based upon volume of abrasive composite 0.2 to 0.8 parts abrasive particles and 0.2 to 0.8 parts binder precursor. This volume ratio is based just upon the abrasive particles and binder precursor, and does not include the volume contribution of the backing or optional fillers or additives.

The binder precursor is preferably a curable organic material (i.e., a polymer or material capable of polymerizing and/or crosslinking upon exposure to heat and/or other sources of energy, such as electron beam, ultraviolet light, visible light, etc., or with time upon the addition of a chemical catalyst, moisture, or other agent which cause the polymer to cure or polymerize). Binder precursor examples include epoxy polymers, amino polymers or aminoplast polymers such as alkylated urea-formaldehyde polymers, melamine-formaldehyde polymers, and alkylated benzoguanamine-formaldehyde polymer, acrylate polymers including acrylates and methacrylates alkyl acrylates, acrylated epoxies, acrylated urethanes, acrylated polyesters, acrylated polyethers, vinyl ethers, acrylated oils, and acrylated silicones, alkyd polymers such as urethane alkyd polymers, polyester polymers, reactive urethane polymers, phenolic polymers such as resole and novolac polymers, phenolic/latex polymers, epoxy polymers such as bisphenol epoxy polymers, isocyanates, isocyanurates, polysiloxane polymers including alkylalkoxysilane polymers, or reactive vinyl polymers. The resulting binder may be in the form of monomers, oligomers, polymers, or combinations thereof.

The aminoplast binder precursors have at least one pendant alpha, beta-unsaturated carbonyl group per molecule or oligomer. These polymer materials are further described in U.S. Pat. No. 4,903,440 (Larson et al.) and U.S. Pat. No. 5,236,472 (Kirk et al.), both incorporated herein by reference.

Preferred binders are generated from free radical curable binder precursors. These binders are capable of polymerizing rapidly upon exposures to thermal energy or radiation energy. One preferred subset of free radical curable binder precursors include ethylenically unsaturated binder precursors. Examples of such ethylenically unsaturated binder precursors include aminoplast monomers or oligomers having pendant alpha, beta unsaturated carbonyl groups, ethylenically unsaturated monomers or oligomers, acrylated isocyanurate monomers, acrylated urethane oligomers, acrylated epoxy monomers or oligomers, ethylenically unsaturated monomers or diluents, acrylate dispersions, and mixtures thereof The term acrylate includes both acrylates and methacrylates.

Ethylenically unsaturated binder precursors include both monomeric and polymeric compounds that contain atoms of carbon, hydrogen and oxygen, and optionally, nitrogen and the halogens. Oxygen or nitrogen atoms or both are generally present in the form of ether, ester, urethane, amide, and urea groups. The ethylenically unsaturated monomers may be monofunctional, difunctional, trifunctional, tetrafunctional or even higher functionality, and include both acrylate and methacrylate-based monomers: Suitable ethylenically unsaturated compounds are preferably esters made from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, or maleic acid. Representative examples of ethylenically unsaturated monomers include methyl methacrylate, ethyl methacrylate, styrene, divinylbenzene, hydroxyethyl acrylate, hydroxyethyl methacrylate, hydroxypropyl acrylate, hydroxy propyl methacrylate, hydroxybutyl acrylate, hydroxybutyl methacrylate, lauryl acrylate, octyl acrylate, caprolactone acrylate, caprolactone methacrylate, tetrahydrofurfuryl methacrylate, cyclohexyl acrylate, stearyl acrylate, 2-phenoxyethyl acrylate, isooctyl acrylate, isobornyl acrylate, isodecyl acrylate, polyethylene glycol monoacrylate, polypropylene glycol monoacrylate, vinyl toluene, ethylene glycol diacrylate, polyethylene glycol diacrylate, ethylene glycol dimethacrylate, hexanediol diacrylate, triethylene glycol diacrylate, 2 (2-ethoxyethoxy) ethyl acrylate, propoxylated trimethylol propane triacrylate, trimethylolpropane triacrylate, glycerol triacrylate, pentaerthyitol triacrylate, pentaerythritol trimethacrylate, pentaerythritol tetraacrylate and pentaerythritol tetramethacrylate. Other ethylenically unsaturated materials include monoallyl, polyallyl, or polymethallyl esters and amides of carboxylic acids, such as diallyl phthalate, diallyl adipate, or N,N-diallyladipamide. Still other nitrogen containing ethylenically unsaturated monomers include tris(2-acryloxyethyl)isocyanurate, 1,3,5-tri(2-methyacryloxyethyl)-s-triazine, acrylamide, methylacrylamide, N-methylacrylamide, N,N-dimethylacrylamide, N-vinyl-pyrrolidone, or N-vinyl-piperidone.

A preferred binder precursor contains a blend of two or more acrylate monomers. For example, the binder precursor may be a blend of trifunctional acrylate and a monofunctional acrylate monomers. An example of one binder precursor is a blend of propoxylated trimethylol propane triacrylate and 2 (2-ethoxyethoxy) ethyl acrylate. The weight ratios of multifunctional acrylate and monofunctional acrylate polymers may range from about 1 part to about 90 parts multifunctional acrylate to about 10 parts to about 99 parts monofunctional acrylate.

It is also feasible to formulate a binder precursor from a mixture of an acrylate and an epoxy polymer, e.g., as described in U.S. Pat. No. 4,751,138 (Tumey et al.), incorporated herein by reference.

Other binder precursors include isocyanurate derivatives having at least one pendant acrylate group and isocyanate derivatives having at least one pendant acrylate group are further described in U.S. Pat. No. 4,652,274 (Boettcher et al.), incorporated herein by reference. The preferred isocyanurate material is a triacrylate of tris(hydroxyethyl) isocyanurate.

Still other binder precursors include diacrylate urethane esters as well as polyacrylate or poly methacrylate urethane esters of hydroxy terminated isocyanate extended polyesters or polyethers. Examples of commercially available acrylated urethanes include those under the tradename "UVITHANE 782", available from Morton Chemical; "CMD 6600", "CMD 8400", and "CMD 8805", available from UCB Radcure Specialties, Smyrna, Ga.; "PHOTOMER" resins (e.g., PHOTOMER 6010) from Henkel Corp., Hoboken, N.J.; "EBECRYL 220" (hexafunctional aromatic urethane acrylate), "EBECRYL 284" (aliphatic urethane diacrylate of 1200 diluted with 1,6-hexanediol diacrylate), "EBECRYL 4827" (aromatic urethane diacrylate), "EBECRYL 4830" (aliphatic urethane diacrylate diluted with tetraethylene glycol diacrylate), "EBECRYL 6602" (trifunctional aromatic urethane acrylate diluted with trimethylolpropane ethoxy triacrylate), "EBECRYL 840" (aliphatic urethane diacrylate), and "EBECRYL 8402" (aliphatic urethane diacrylate) from UCB Radcure Specialties; and "SARTOMER" resins (e.g., "SARTOMER" 9635, 9645, 9655, 963-B80, 966-A80, CN980M50, etc.) from Sartomer Co., Exton, Pa.

Yet other binder precursors include diacrylate epoxy esters as well as polyacrylate or poly methacrylate epoxy ester such as the diacrylate esters of bisphenol A epoxy polymer. Examples of commercially available acrylated epoxies include those under the tradename "CMD 3500", "CMD 3600", and "CMD 3700", available from UCB Radcure Specialties.

Other binder precursors may also be acrylated polyester polymers. Acrylated polyesters are the reaction products of acrylic acid with a dibasic acid/aliphatic diol-based polyester. Examples of commercially available acrylated polyesters include those known by the trade designations "PHOTOMER 5007" (hexafunctional acrylate), and "PHOTOMER 5018" (tetrafunctional tetracrylate) from Henkel Corp.; and "EBECRYL 80" (tetrafunctional modified polyester acrylate), "EBECRYL 450" (fatty acid modified polyester hexaacrylate) and "EBECRYL 830" (hexafunctional polyester acrylate) from UCB Radcure Specialties.

Another preferred binder precursor is a blend of ethylenically unsaturated oligomer and monomers. For example the binder precursor may comprise a blend of an acrylate functional urethane oligomer and one or more monofunctional acrylate monomers. This acrylate monomer may be a pentafunctional acrylate, tetrafunctional acrylate, trifunctional acrylate, difunctional acrylate, monofunctional acrylate polymer, or combinations thereof.

The binder precursor may also be an acrylate dispersion like that described in U.S. Pat. No. 5,378,252 (Follensbee), incorporated herein by reference.

In addition to thermosetting binders, thermoplastic binders may also be used. Examples of suitable thermoplastic binders include polyamides, polyethylene, polypropylene, polyesters, polyurethanes, polyetherimide, polysulfone, polystyrene, acrylonitrile-butadiene-styrene block copolymer, styrene-butadiene-styrene block copolymers, styrene-isoprene-styrene block copolymers, acetal polymers, polyvinyl chloride and combinations thereof.

Water-soluble binder precursors optionally blended with a thermosetting resin may be used. Examples of water-soluble binder precursors include polyvinyl alcohol, hide glue, or water-soluble cellulose ethers such as hydroxypropylmethyl cellulose, methyl cellulose or hydroxyethylmethyl cellulose. These binders are reported in U.S. Pat. No. 4,255,164 (Butkze et al.), incorporated herein by reference.

In the case of binder precursors containing ethylenically unsaturated monomers and oligomers, polymerization initiators may be used. Examples include organic peroxides, azo compounds, quinones, nitroso compounds, acyl halides, hydrazones, mercapto compounds, pyrylium compounds, imidazoles, chlorotriazines, benzoin, benzoin alkyl ethers, diketones, phenones, or mixtures thereof Examples of suitable commercially available, ultraviolet-activated photoinitiators have tradenames such as "IRGACURE 651" and "IRGACURE 184" commercially available from the Ciba Geigy Company and "DAROCUR 1173" commercially available from Merck. Another visible light-activated photoinitiator has the trade name "IRGACURE 369" commercially available from Ciba Geigy Company. Examples of suitable visible light-activated initiators are reported in U.S. Pat. No. 4,735,632.

A suitable initiator system may include a photosensitizer. Representative photosensitizer may have carbonyl groups or tertiary amino groups or mixtures thereof. Preferred photosensitizers having carbonyl groups are benzophenone, acetophenone, benzil, benzaldehyde, o-chlorobenzaldehyde, xanthone, thioxanthone, 9,10-anthraquinone, or other aromatic ketones. Preferred photosensitizers having tertiary amines are methyldiethanolamine, ethyldiethanolamine, triethanolamine, phenylmethyl-ethanolamine, or dimethylaminoethylbenzoate. Commercially available photosensitizers include "QUANTICURE ITX", "QUANTICURE QTX", "QUANTICURE PTX", "QUANTICURE EPD" from Biddle Sawyer Corp.

In general, the amount of photosensitizer or photoinitiator system may vary from about 0.01 to 10% by weight, more preferably from 0.25 to 4.0% by weight of the components of the binder precursor.

Additionally, it is preferred to disperse (preferably uniformly) the initiator in the binder precursor before addition of any particulate material, such as the abrasive particles and/or filler particles.

In general, it is preferred that the binder precursor be exposed to radiation energy, preferably ultraviolet light or visible light, to cure or polymerize the binder precursor. In some instances, certain abrasive particles and/or certain additives will absorb ultraviolet and visible light, which may hinder proper cure of the binder precursor. This occurs, for example, with ceria abrasive particles. The use of phosphate containing photoinitiators, in particular acylphosphine oxide containing photoinitiators, may minimize this problem. An example of such an acylphosphate oxide is 2,4,6-trimethylbenzoyldiphenylphosphine oxide, which is commercially available from BASF Corporation under the trade designation "LR8893". Other examples of commercially available acylphosphine oxides include "Darocur 4263" and "Darocur 4265" commercially available from Merck.

Cationic initiators may be used to initiate polymerization when the binder is based upon an epoxy or vinyl ether. Examples of cationic initiators include salts of onium cations, such as arylsulfonium salts, as well as organometallic salts such as ion arene systems. Other examples are reported in U.S. Pat. No. 4,751,138 (Tumey et al.); U.S. Pat. No. 5,256,170 (Harmer et al.); U.S. Pat. No. 4,985,340 (Palazotto); and U.S. Pat. No. 4,950,696, all incorporated herein by reference.

Dual-cure and hybrid-cure photoinitiator systems may also be used. In dual-cure photoiniator systems, curing or polymerization occurs in two separate stages, via either the same or different reaction mechanisms. In hybrid-cure photoinitiator systems, two curing mechanisms occur at the same time upon exposure to ultraviolet/visible or electron-beam radiation.

Abrasive Composite

The abrasive composite comprises a plurality of abrasive particles fixed and dispersed in a binder, but may include other additives such as abrasive particle surface modification agents, passivating agents, coupling agents, fillers, expanding agents, fibers, antistatic agents, reactive diluents, initiators, suspending agents, lubricants, wetting agents, surfactants, pigments, dyes, WV stabilizers, complexing agents, chain transfer agents, accelerators, catalysts, or activators. The amounts of these additives are selected to provide the properties desired.

The abrasive composite may optionally include a plasticizer. In general, the addition of the plasticizer will increase the erodibility of the abrasive composite and soften the overall binder composition. In some instances, the plasticizer will act as a diluent for the binder precursor. The plasticizer is preferably compatible with the binder to minimize phase separation. Examples of suitable plasticizers include polyethylene glycol, polyvinyl chloride, dibutyl phthalate, alkyl benzyl phthalate, polyvinyl acetate, polyvinyl alcohol, cellulose esters, silicone oils, adipate and sebacate esters, polyols, polyols derivatives, t-butylphenyl diphenyl phosphate, tricresyl phosphate, castor oil, or combinations thereof. Phthalate derivatives are one type of preferred plasticizers.

In addition, water and/or organic solvent may be incorporated into the abrasive composite. The amount of water and/or organic solvent is selected to achieve the desired coating viscosity of binder precursor and abrasive particles. In general, the water and/or organic solvent should be compatible with the binder precursor. The water and/or solvent may be removed following polymerization of the precursor, or it may remain with the abrasive composite. Suitable water soluble and/or water sensitive additives include polyvinyl alcohol, polyvinyl acetate, or cellulosic based particles.

Examples of ethylenically unsaturated diluents or monomers can be found in U.S. Pat. No. 5,236,472 (Kirk et al.), incorporated herein by reference. In some instances these ethylenically unsaturated diluents are useful because they tend to be compatible with water. Additional reactive diluents are disclosed in U.S. Pat. No. 5,178,646 (Barber et al.), incorporated herein by reference.

Abrasive Composite Configuration

There are many different forms of three-dimensional, textured, fixed abrasive articles. Examples of representative forms are schematically illustrated in FIGS. 1 and 2.

Figure 2:
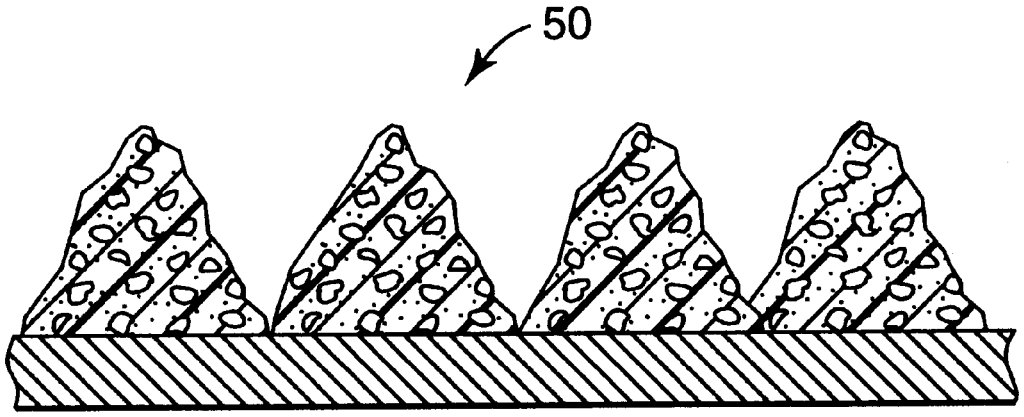
FIG. 2 is a cross sectional view of a portion of a second fixed abrasive article.

Preferred fixed abrasive articles contain abrasive composite structures that are precisely shaped as illustrated in FIG. 1, or irregularly shaped as in FIG. 2. Abrasive composite structures may be referred to simply as abrasive composites. Fixed abrasive articles having precisely shaped abrasive composite structures are most preferred. The fixed abrasive article 50 in FIG. 2 has irregular shape, pyramidal abrasive composite structures. The imperfect shape can be formed by the slurry flowing and distorting an initially formed shape prior to curing or solidification of the binder precursor. An irregular shape is illustrated by non-straight, non-clear, non-reproducible, inexact or imperfect planes or shape boundaries.

The binder and abrasive particles may provide a plurality of shaped abrasive composites. The abrasive composite shape may have a variety of geometric configurations. Typically the base of the shape in contact with the backing has a larger surface area than the distal end of the composite. The shape of the composite may be selected from among a number of geometric solids such as a cubic, cylindrical, prismatic, right parallelepiped, pyramidal, truncated pyramidal, conical, hemispherical, truncated conical, cross, or post-like cross sections with a distal end. Composite pyramids may have four sides, five sides or six sides. The cross-sectional shape of the abrasive composite at the base may differ from the cross-sectional shape at the distal end. The transition between these shapes may be smooth and continuous or may occur in discrete steps. The abrasive composites may also have a mixture of different shapes. The abrasive composites may be arranged in rows, spiral, helix, or lattice fashion, or may be randomly placed.

The sides forming the abrasive composites may be perpendicular relative to the backing, tilted relative to the backing or tapered with diminishing width toward the distal end. The tapered angle may range from about 1 to 75 degrees, preferably from about 2 to 50 degrees, more preferably from about 3 to 35 degrees and most preferably between about 5 to 15 degrees. The smaller angles are preferred because this results in a more uniform cross sectional area along the height of the abrasive composite. An abrasive composite with a cross section that is larger at the distal end than at the back may also be used, although fabrication may be more difficult. The height of each abrasive composite is preferably the same, but it is possible to have composites of varying heights in a single fixed abrasive article. The height of the composites generally may be less than about 2000 micrometers, and more particularly in the range of about 25 to 200 micrometers.

The base of the abrasive composites may abut one another or, alternatively, the bases of adjacent abrasive composites may be separated from one another by some specified distance. In some embodiments, the physical contact between adjacent abrasive composites involves no more than 33% of the vertical height dimension of each contacting composite. More preferably, the amount of physical contact between the abutting composites is in the range of 1 to 25% of the vertical height of each contacting composite. This definition of abutting also covers an arrangement where adjacent composites share a common abrasive composite land or bridge-like structure which contacts and extends between facing sidewalls of the composites. Preferably, the land structure has a height of no greater than 33% of the vertical height dimension of each adjacent composite. The abrasive composite land is formed from the same slurry used to form the abrasive composites. The composites are "adjacent" in the sense that no intervening composite is located on a direct imaginary line drawn between the centers of the composites. It is preferred that at least portions of the abrasive composites be separated from one another so as to provide recessed areas between raised portions of the composites.

The linear spacing of the abrasive composites may range from about 1 abrasive composite per linear cm to about 100 abrasive composite per linear cm. The linear spacing may be varied such that the concentration of composites is greater in one location than in another. For example, the concentration may be greatest in the center of the fixed abrasive article. The areal density of composites ranges from about 1 to 10,000 composites/$cm^2$.

It is also feasible to have areas of the backing exposed, i.e., where the abrasive coating does not cover the entire surface area of the backing. This type of arrangement is further described in U.S. Pat. No. 5,014,468 (Ravipati et al.), incorporated herein by reference.

The abrasive composites are preferably set out on a backing in a predetermined pattern or set out on a backing at a predetermined location. For example, in the fixed abrasive article made by providing a slurry between the backing and a production tool having cavities therein, the predetermined pattern of the composites will correspond to the pattern of the cavities on the production tool. The pattern is thus reproducible from article to article.

In one embodiment of the predetermined pattern, the abrasive composites are in an array or arrangement, by which is meant that the composites are in a regular array such as aligned rows and columns, or alternating offset rows and columns. If desired, one row of abrasive composites may be directly aligned in front of a second row of abrasive composites. Preferably, one row of abrasive composites may be offset from the second row of abrasive composites.

In another embodiment, the abrasive composites may be set out in a "random" array or pattern. By this it is meant that the composites are not in a regular array of rows and columns as described above. For example, the abrasive composites may be set out in a manner as described in WO PCT 95/07797 published Mar. 23, 1995 (Hoopman et al.) and WO PCT 95/22436 published Aug. 24, 1995 (Hoopman et al.). It is understood, however, that this "random" array is a predetermined pattern in that the location of the composites on the fixed abrasive article is predetermined and corresponds to the location of the cavities in the production tool used to make the fixed abrasive article.

Backing

The fixed abrasive article may include a backing that is preferably uniform in thickness. If the backing is not sufficiently uniform in thickness, a greater variability in the wafer uniformity will result. A variety of backing materials are suitable for this purpose, including both flexible backings and backings that are more rigid. Examples of typical flexible abrasive backings include polymeric film, primed polymeric film, metal foil, cloth, paper, vulcanized fiber, nonwovens and treated versions thereof and combinations thereof One preferred type of backing is a polymeric film. Examples of such films include polyester films, polyester and co-polyester films, microvoided polyester films, polyimide films, polyamide films, polyvinyl alcohol films, polypropylene film, polyethylene film, and the like. The thickness of the polymeric film backing generally ranges between about 20 to 1000 micrometers, preferably between 50 to 500 micrometers and more preferably between 60 to 200 micrometers.

There should also be good adhesion between the polymeric film backing and the abrasive composite. In many instances, the surface of polymeric film backing is primed to improve adhesion. The primer can involve surface alteration or application of a chemical-type primer. Examples of surface alterations include corona treatment, UV treatment, electron beam treatment, flame treatment and scuffing to increase the surface area. Examples of chemical-type primers include ethylene acrylic acid copolymer as disclosed in U.S. Pat. No. 3,188,265, colloidal dispersion as taught in U.S. Pat. No. 4,906,523, incorporated herein by reference, aziridine-type materials as disclosed in U.S. Pat. No. 4,749,617 and radiation grafted primers as taught in U.S. Pat. Nos. 4,563,388 and 4,933,234.

Examples of more rigid backings include metal plates, ceramic plates, and the like. Another example of a suitable backing is described in U.S. Pat. No. 5,417,726 (Stout et al.) incorporated herein by reference. The backing may also consist of two or more backings laminated together, as well as reinforcing fibers engulfed in a polymeric material as disclosed in PCT publication WO 93/12911 (Benedict et al.).

Also suitable are backings in the form of an embossed polymeric film (e.g., a polyester, polyurethane, polycarbonate, polyamide, polypropylene, or polyethylene film) or embossed cellulosic backing (e.g., paper or other nonwoven cellulosic material). The embossed material can also be laminated to a non-embossed material to form the backing. The embossed pattern can be any texture. For example, the pattern can be in the form of an hexagonal array, ridges, lattices, spheres, pyramids,. truncated pyramids, cones, cubes, blocks, rods, and the like.

A pressure sensitive adhesive can be laminated to the nonabrasive side of the backing of the particle abrasive. The pressure sensitive adhesive can be coated directly onto the surface of the backing. Alternatively, the pressure sensitive adhesive can be a transfer tape that is laminated to the surface of the backing. In another aspect of the invention, a foam substrate can be laminated to the backing.

Abrasive Construction

Figure 3:
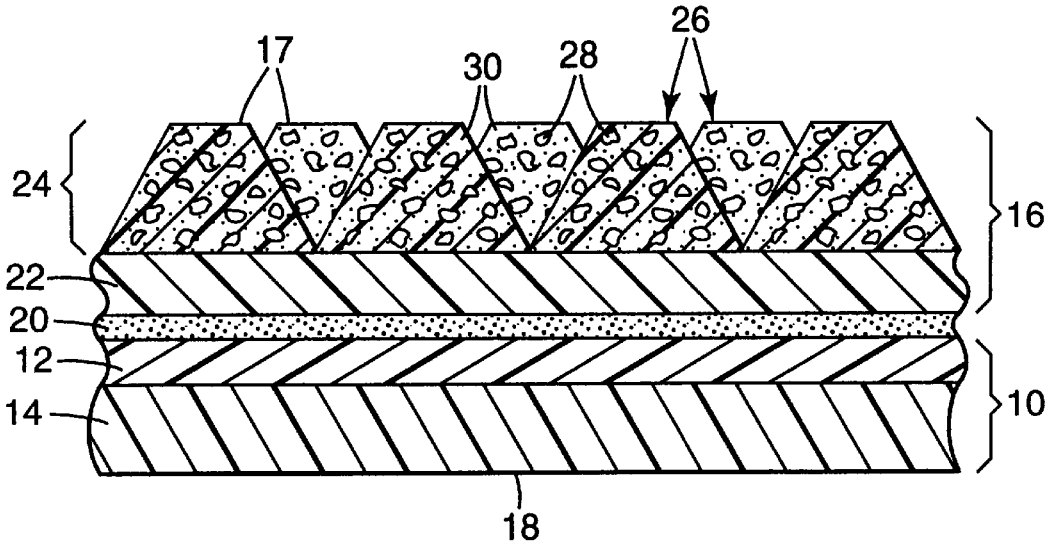
FIG. 3 is a cross sectional view of a portion of an abrasive construction.

A fixed abrasive article of the present invention may be a component of a fixed abrasive construction. An example of an abrasive construction is illustrated in FIG. 3 where a subpad 10 includes at least one rigid element 12 and at least one resilient element 14, which is attached to a fixed abrasive article 16. The rigid element 12 is interposed between the resilient element 14 and the fixed abrasive article 16, which has surfaces 17 that contact a semiconductor wafer. Thus, in the abrasive constructions of the present invention, the rigid element 12 and the resilient element 14 are generally continuous with, and parallel to, the fixed abrasive article 16, such that the three elements are substantially coextensive. Although not shown in FIG. 2, surface 18 of the resilient element 14 is typically attached to a platen of a machine for semiconductor wafer modification, and surfaces 17 of the fixed abrasive article contacts the semiconductor wafer.

As shown in FIG. 3, this embodiment of the fixed abrasive article 16 includes a backing 22 having a surface to which is bonded an abrasive coating 24, which includes a predetermined pattern of a plurality of precisely shaped abrasive composites 26 comprising abrasive particles 28 dispersed in a binder 30. Abrasive coating 24 may be continuous or discontinuous on the backing. In certain embodiments, however, the fixed abrasive article does not require a backing. Furthermore, the rigid element of the abrasive construction could be provided by the backing of the fixed abrasive article, at least in part. Although FIG. 3 displays a textured, three-dimensional, fixed abrasive element having a precisely shaped abrasive composite, the abrasive compositions of the present invention are not limited to a precisely shaped composite.

The primary purpose of the resilient element is to allow the abrasive construction to substantially conform to the global topography of the surface of the wafer while maintaining a uniform pressure on the wafer. For example, a semiconductor wafer may have an overall shape with relatively large undulations or variations in thickness, which the abrasive construction should substantially match. It is desirable to provide substantial conformance of the abrasive construction to the global topography of the wafer so as to achieve the desired level of uniformity after modification of the wafer surface. Because the resilient element undergoes compression during a surface modification process, its resiliency when compressed in the thickness direction is an important characteristic for achieving this purpose. The resiliency (i.e., the stiffness in compression and elastic rebound) of the resilient element is related to the modulus of the material in the thickness direction, and is also affected by its thickness. "Modulus" refers to the elastic modulus or Young's Modulus of a material; for a resilient material it is measured using a dynamic compressive test in the thickness direction of the material, whereas for a rigid material it is measured using a static tension test in the plane of the material.

The primary purpose of the rigid element is to limit the ability of the abrasive construction to substantially conform to the local features of the surface of the wafer. For example, a semiconductor wafer typically has adjacent features of the same or different heights with valleys between, the topography to which the abrasive construction should not substantially conform. It is desirable to attenuate conformance of the abrasive construction to the local topography of the wafer so as to achieve the desired level of planarity of the wafer (e.g., avoid dishing). The bending stiffness (i.e., resistance to deformation by bending) of the rigid element is an important characteristic for achieving this purpose. The bending stiffness of the rigid element is directly related to the in-plane modulus of the material and is affected by its thickness. For example, for a homogeneous material, the bending stiffness is directly proportional to its Young's Modulus times the thickness of the material raised to the third power.

The materials suitable for use in the subpad can be characterized using standard test methods proposed by ASTM (Standard Test Methods of Tension Testing), for example. Static tension testing of rigid materials can be used to measure the Young's Modulus (often referred to as the elastic modulus) in the plane of the material. For measuring the Young's Modulus of a metal, ASTM E345-93 (Standard Testing Methods of Tension Testing of Metallic Foil) can be used. For measuring the Young's Modulus of an organic polymer (e.g., plastics or reinforced plastics), ASTM D638-84 (Standard Test Methods for Tensile Properties of Plastics) and ASTM D882-88 (Standard Tensile Properties of Thin Plastic Sheet) can be used. For laminated elements that include multiple layers of materials, the Young's Modulus of the overall element (i.e., the laminate modulus) can be measured using the test for the highest modulus material. Preferably, rigid materials (or the overall rigid element itself) have a Young's Modulus value of at least about 100 MPa. Herein, the Young's Modulus of the rigid element is determined by the appropriate ASTM test in the plane defined by the two major surfaces of the material at room temperature (20–25° C.).

Dynamic compressive testing of resilient materials can be used to measure the Young's Modulus (often referred to as the storage or elastic modulus) in the thickness direction of the material. Herein, for resilient materials ASTM D5024-94 (Standard Test Methods for Measuring the Dynamic Mechanical Properties of Plastics in Compression) is used, whether the resilient element is one layer or a laminated element that includes multiple layers of materials. Preferably, resilient materials (or the overall resilient element itself) have a Young's Modulus value of less than about 100 MPa, and more preferably less than about 50 MPa. Herein, the Young's Modulus of the resilient element is determined by ASTM D5024-94 in the thickness direction of the material at 20° C. and 0.1 Hz with a preload of 34.5 kPa.

Specific details of a fixed abrasive construction are found in U.S. patent application Ser. No. 08/694,357, now U.S. Pat. No. 5,692,950, incorporated herein by reference.

Methods Of Making Fixed Abrasive Articles

A preferred method for making a fixed abrasive article having precisely shaped abrasive composites is described in U.S. Pat. No. 5,152,917 (Pieper et al) and U.S. Pat. No. 5,435,816 (Spurgeon et al.), both incorporated herein by reference. Other descriptions of suitable methods are reported in U.S. Pat. Nos. 5,437,754; 5,454,844 (Hibbard et al.); U.S. Pat. No. 5,437,7543 (Calhoun); and U.S. Pat. No. 5,304,223 (Pieper et al.), all incorporated herein by reference. Manufacture is preferably conducted in a clean room type environment (e.g., a class 100, class 1,000, or class 10,000 clean room) to minimize any contamination in the fixed abrasive article.

A suitable method includes preparing a slurry comprising abrasive particles, binder precursor and optional additives; providing a production tool having a front surface; introducing the slurry into the cavities of a production tool having a plurality of cavities; introducing a backing to the slurry covered surface of the production tool; and at least partially curing or gelling the binder precursor before the article departs from the cavities of the production tool to form abrasive composites.

The slurry is made by combining together by any suitable mixing technique the binder precursor, the abrasive particles and the optional additives. Examples of mixing techniques include low shear and high shear mixing, with high shear mixing being preferred. Ultrasonic energy may also be utilized in combination with the mixing step to lower the slurry viscosity (the viscosity being important in the manufacture of the fixed abrasive article) and/or affect the rheology of the resulting abrasive slurry. Alternatively, the slurry may be heated in the range of 30 to 70° C., microfluidized or ball milled in order to mix the slurry.

Typically, the abrasive particles are gradually added into the binder precursor. It is preferred that the slurry be a homogeneous mixture of binder precursor, abrasive particles and optional additives. If necessary water and/or solvent is added to lower the viscosity. The formation of air bubbles may be minimized by pulling a vacuum either during or after the mixing step.

The coating station can be any conventional coating means such as drop die coater, knife coater, curtain coater, vacuum die coater or a die coater. The preferred coating technique is a vacuum fluid bearing die reported in U.S. Pat. Nos. 3,594,865; 4,959,265 (Wood); and U.S. Pat. No. 5,077,870 (Millage), which are incorporated herein by reference. During coating, the formation of air bubbles is preferably minimized although in some instances it may be preferred to incorporate air into the slurry as the slurry is being coated into the production tool. Entrapped air may led to porosity such as voids in the abrasive coating and possibly increase the erodibility of the abrasive composite. Additionally, a gas can be pumped into the slurry either during mixing or coating.

After the production tool is coated, the backing and the slurry are brought into contact by any means such that the slurry wets a surface of the backing. The slurry is brought into contact with the backing by contact nip roll which forces the resulting construction together. The nip roll may be made from any material; however, the nip roll is preferably made from a structural material such as metal, metal alloys, rubber or ceramics. The hardness of the nip roll may vary from about 30 to 120 durometer, preferably about 60 to 100 durometer, and more preferably about 90 durometer.

Next, energy is transmitted into the slurry by an energy source to at least partially cure the binder precursor. The selection of the energy source will depend in part upon the chemistry of the binder precursor, the type of production tool as well as other processing conditions. The energy source should not appreciably degrade the production tool or backing. Partial cure of the binder precursor means that the binder precursor is polymerized to such a state that the slurry does not flow when inverted in the production tool. If needed, the binder precursor may be fully cured after it is removed from the production tool using conventional energy sources.

After at least partial cure of the binder precursor, the production tool and fixed abrasive article are separated. If the binder precursor is not fully cured, the binder precursor can then be fully cured by either time and/or exposure to an energy source. Finally, the production tool is rewound on mandrel so that the production tool can be reused again and the fixed abrasive article is wound on the mandrel.

In another variation of this first method, the slurry is coated onto the backing and not into the cavities of the production tool. The slurry coated backing is then brought into contact with the production tool such that the slurry flows into the cavities of the production tool. The remaining steps to make the fixed abrasive article are the same as detailed above.

It is preferred that the binder precursor is cured by radiation energy. The radiation energy may be transmitted through the backing or through the production tool. The backing or production tool should not appreciably absorb the radiation energy. Additionally, the radiation energy source should not appreciably degrade the backing or production tool. For instance, ultraviolet light can be transmitted through a polyester backing. Alternatively, if the production tool is made from certain thermoplastic materials, such as polyethylene, polypropylene, polyester, polycarbonate, poly (ether sulfone), poly(methyl methacrylate), polyurethanes, polyvinylchloride, or combinations thereof, ultraviolet or visible light may be transmitted through the production tool and into the slurry. For thermoplastic based production tools, the operating conditions for making the fixed abrasive article should be set such that excessive heat is not generated. If excessive heat is generated, this may distort or melt the thermoplastic tooling.

The energy source may be a source of thermal energy or radiation energy, such as electron beam, ultraviolet light, or visible light. The amount of energy required depends on the chemical nature of the reactive groups in the binder precursor, as well as upon the thickness and density of the binder slurry. For thermal energy, an oven temperature of from about 50° C. to about 250° C. and a duration of from about 15 minutes to about 16 hours are generally sufficient. Electron beam radiation or ionizing radiation may be used at an energy level of about 0.1 to about 10 Mrad, preferably at an energy level of about 1 to about 10 Mrad. Ultraviolet radiation includes radiation having a wavelength within a range of about 200 to about 400 nanometers, preferably within a range of about 250 to 400 nanometers. Visible radiation includes radiation having a wavelength within a range of about 400 to about 800 nanometers, preferably in a range of about 400 to about 550 nanometers.

The resulting solidified slurry or abrasive composite will have the inverse pattern of the production tool. By at least partially curing or solidifying on the production tool, the abrasive composite has a precise and predetermined pattern.

The production tool has a front surface which contains a plurality of cavities or indentations. These cavities are essentially the inverse shape of the abrasive composite and are responsible for generating the shape and placement of the abrasive composites.

These cavities may have geometric shapes that are the inverse shapes of the abrasive composites. The dimensions of the cavities are selected to achieve the desired number of abrasive composites/square centimeter. The cavities may be present in a dot-like pattern where adjacent cavities butt up against one another at their portions where the indentations merge into a common planar major surface of the production tool formed in the interstices of the cavities.

The production tool may be in the form of a belt, a sheet, a continuous sheet or web, a coating roll such as a rotogravure roll, a sleeve mounted on a coating roll, or die. The production tool may be made of metal, (e.g., nickel), metal alloys, or plastic. The production tool is fabricated by conventional techniques, including photolithography, knurling, engraving, hobbing, electroforming, or diamond turning. For example, a copper tool may be diamond turned and then a nickel metal tool may be electroplated off of the copper tool. Preparations of production tools are reported in U.S. Pat. No. 5,152,917 (Pieper et al.); U.S. Pat. No. 5,489,235 (Gagliardi et al.); U.S. Pat. No. 5,454,844 (Hibbard et al.); U.S. Pat. No. 5,435,816 (Spurgeon et al.); PCT WO 95/07797 (Hoopman et al.); and PCT WO 95/22436 (Hoopman et al.), all incorporated herein by reference.

A thermoplastic tool may be replicated off a metal master tool. The master tool will have the inverse pattern desired for the production tool. The master tool is preferably made of metal, such as nickel-plated aluminum, copper or bronze. A thermoplastic sheet material optionally may be heated along with the master tool such that the thermoplastic material is embossed with the master tool pattern by pressing the two together. The thermoplastic material can also be extruded or cast onto to the master tool and then pressed. The thermoplastic material is cooled to a nonflowable state and then separated from the master tool to produce a production tool.

Suitable thermoplastic production tools are reported in U.S. Pat. No. 5,435,816 (Spurgeon et al.), incorporated herein by reference. Examples of thermoplastic materials useful to form the production tool include polyesters, polypropylene, polyethylene, polyamides, polyurethanes, polycarbonates, or combinations thereof It is preferred that the thermoplastic production tool contain additives such as anti-oxidants and/or UV stabilizers. These additives may extend the useful life of the production tool. The production tool may also contain a release coating to permit easier release of the fixed abrasive article from the production tool. Examples of such release coatings include silicones and fluorochemicals.

There are many methods for making abrasive composites having irregularly shaped abrasive composites. While being irregularly shaped, these abrasive composites may nonetheless be set out in a predetermined pattern, in that the location of the composites is predetermined. In one method, the slurry is coated into cavities of a production tool to generate the abrasive composites. The production tool may be the same production tool as described above in the case of precisely shaped composites. However, the slurry is removed from the production tool before the binder precursor is cured or solidified sufficiently for it to substantially retain its shape upon removal from the production tool. Subsequent to this, the binder precursor is cured or solidified. Since the binder precursor is not cured while in the cavities of the production tool, this results in the slurry flowing and distorting the abrasive composite shape.

Methods to make this type of fixed abrasive article are reported in U.S. Pat. No. 4,773,920 (Chasman et al.) and U.S. Pat. No. 5,014,468 (Ravipati et al.), both incorporated herein by reference.

In a variation of this method, the slurry can be coated onto the backing. The backing is then brought into contact with the production tool such that the cavities of the production tool are filled by the slurry. The remaining steps to make the fixed abrasive article are the same as detailed above. After the fixed abrasive article is made, it can be flexed and/or humidified prior to converting.

In another method of making irregularly shaped composites, the slurry can be coated onto the surface of a rotogravure roll. The backing comes into contact with the rotogravure roll and the slurry wets the backing. The rotogravure roll then imparts a pattern or texture into the slurry. Next, the slurry/backing combination is removed from the rotogravure roll and the resulting construction is exposed to conditions to solidify the binder precursor such that an abrasive composite is formed. A variation of this process is to coat the slurry onto the backing and bring the backing into contact with the rotogravure roll.

The rotogravure roll may impart desired patterns such as a hexagonal array, ridges, lattices, spheres, pyramids, truncated pyramids, cones, cubes, blocks, or rods. The rotogravure roll may also impart a pattern such that there is a land area between adjacent abrasive composites. This land area can comprise a mixture of abrasive particles and binder. Alternatively, the rotogravure roll can impart a pattern such that the backing is exposed between adjacent abrasive composite shapes. Similarly, the rotogravure roll can impart a pattern such that there is a mixture of abrasive composite shapes.

Another method is to spray or coat the slurry through a screen to generate a pattern and the abrasive composites. Then the binder precursor is cured or solidified to form the abrasive composites. The screen can impart any desired pattern such as a hexagonal array, ridges, lattices, spheres, pyramids, truncated pyramids, cones, cubes, blocks, or rods. The screen may also impart a pattern such that there is a land area between adjacent abrasive composites. This land area can comprise a mixture of abrasive particles and binder. Alternatively, the screen may impart a pattern such that the backing is exposed between adjacent abrasive composites. Similarly, the screen may impart a pattern such that there is a mixture of abrasive composite shapes. This process is reported in U.S. Pat. No. 3,605,349 (Anthon), incorporated herein by reference.

Another method to make a three-dimensional, textured, fixed abrasive article uses embossed backings. Briefly, an embossed backing is coated with a slurry. The slurry follows the contours of the embossed backing to provide a textured coating. The slurry may be applied over the embossed backing by any suitable technique such as roll coating, spraying, die coating, or knife coating. After the slurry is applied over the embossed backing, the resulting construction is exposed to an appropriate energy source to initiate the curing or polymerization process to form the abrasive composite. An example of abrasive composites on an embossed backing is reported in U.S. Pat. No. 5,015,266 (Yamamoto et al.), incorporated herein by reference.

Another method of making a fixed abrasive article using an embossed backing is reported in U.S. Pat. No. 5,219,462 (Bruxvoort), incorporated herein by reference. A slurry is coated into the recesses of an embossed backing. The slurry contains abrasive particles, binder precursor and an expanding agent. The resulting construction is exposed to conditions such that the expanding agent causes the slurry to expand above the front surface of the backing. Next the binder precursor is solidified to form abrasive composites.

A variation of this embossed backing method uses a perforated backing having an abrasive coating bonded to the front surface of the backing. This perforated backing will have a series or a predetermined placement of holes or cavities that extend through the width of the backing. The slurry is coated (e.g., knife coated) over the backing. These cavities will inherently create a textured abrasive coating.

An alternative method of making the fixed abrasive article uses thermoplastic binder. The article can be prepared with or without a backing. Typically, the thermoplastic binder, abrasive particles and any optional additives are compounded together according to conventional techniques to give a mixture, feeding the mixture into an extruder, and then forming the mixture into pellets or long stands. The fixed abrasive article is then formed according to any of a variety of conventional protocols.

For example, the fixed abrasive article may be formed by injection or compression molding the mixture using a mold having essentially the inverse pattern of the desired pattern of the fixed abrasive article surface. The mixture may also be heated to the point at which it forms a molten slurry, which is then supplied to a mold and cooled. Alternatively, it is also possible to heat the binder until it flows and then add abrasive particles and any additives to form the molten slurry and then convert the molten slurry into abrasive composites using conventional methods.

Apparatus

Equipment described in the prior art for abrasive slurry based planarization of semiconductor wafers may generally be adapted for use with the fixed abrasive articles of the invention with minimal modifications. In many cases, the absence of the relatively opaque slurry in methods of the present invention will simplify the use of such devices and methods. Also, associated in-line metrology devices and methods may also be readily adapted for use with these fixed abrasive articles of the present invention.

Figure 4:
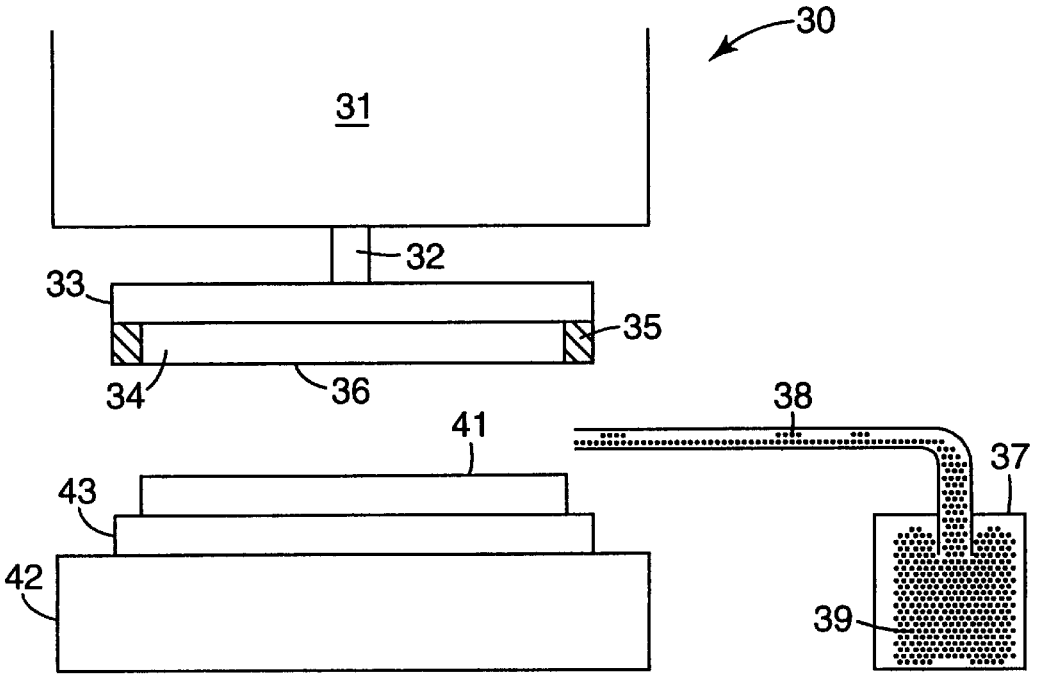
FIG. 4 is a partial side schematic view of one apparatus for modifying the surface of a wafer used in semiconductor fabrication.

FIG. 4 schematically illustrates an apparatus for modifying wafers useful in the process according to the invention. Numerous variations of this machine and/or numerous other machines may be useful with this invention. This type of apparatus and numerous variations and other types of apparatus are known in the art for use with polishing pads and loose abrasive slurries. An example of a suitable commercially available apparatus is a CMP machine available from IPEC/WESTECH of Phoenix, Ariz. Alternative CMP machines are available from STRASBAUGH or SPEEDFAM.

Apparatus 30 comprises head unit 31 connected to a motor (not shown). Chuck 32 extends from head unit 31; an example of such a chuck is a gimbal chuck. The design of chuck 32 preferably accommodates different forces and pivots so that the fixed abrasive article provides the desired surface finish and flatness on the wafer. However, the chuck may or may not allow the wafer to pivot during planarization.

At the end of chuck 31 is wafer holder 33. Wafer holder 33 secures wafer 34 to head unit 31 and also prevents the wafer from becoming dislodged during processing. The wafer holder is designed to accommodate the wafer and may be, for example, circular, oval, rectangular, square, octagonal, hexagonal, or pentagonal.

In some instances, the wafer holder includes two parts, an optional retaining ring and a wafer support pad. The retaining ring may be a generally circular device that fits around the periphery of the semiconductor wafer. The wafer support pad may be fabricated from one or more elements, e.g., polyurethane foam.

Wafer holder 33 extends alongside of semiconductor wafer 34 at ring portion 35. Ring portion (which is optional) may be a separate piece or may be integral with holder 33. In some instances, wafer holder 33 will not extend beyond wafer 34 such that wafer holder 33 does not touch or contact fixed abrasive article 42. In other instances, wafer holder 33 does extend beyond wafer 34 such that the wafer holder does touch or contact the abrasive composite, in which case the wafer holder may influence the characteristics of the abrasive composite. For example, wafer holder 33 may "condition" the fixed abrasive article and remove the outermost portion of the surface of the fixed abrasive article during processing.

The wafer holder or retaining ring may be made out of any material that will allow the fixed abrasive article to impart the desired degree of modification to the wafer. Examples of suitable materials include polymeric materials.

The speed at which wafer holder 33 rotates will depend on the particular apparatus, processing conditions, fixed abrasive article, and the desired wafer modification criteria. In general, however, wafer holder 33 rotates between about 2 to about 1,000 rpm, typically between about 5 to about 500 rpm, preferably between about 10 to about 300 rpm and more preferably between about 20 to about 150 rpm. If the wafer holder rotates too slowly or too quickly, then the desired removal rate may not be achieved.

Wafer holder 33 and/or base 42 may rotate in a circular fashion, spiral fashion linear motion, a non-uniform manner, elliptical fashion as a figure eight or a random motion fashion. The wafer holder or base may oscillate or vibrate.

The fixed abrasive article for use with the currently employed 100 to 500 cm diameter wafers will typically have a diameter between about 10 to 200 cm, preferably between about 20 to 150 cm, more preferably between about 25 to 100 cm. The fixed abrasive article may rotate between about 5 to 10,000 rpm, typically between about 10 to 1000 rpm and preferably between about 10 to 250 rpm. It is preferred that both the wafer and the fixed abrasive article rotate in the same direction. However, the wafer and the fixed abrasive article may also rotate in opposite directions.

The interface between the wafer surface 34 and wafer holder 33 preferably should be relatively flat and uniform to ensure that the desired degree of planarization is achieved. Reservoir 37 holds working liquid 39 (described in more detail below) which is pumped through tubing 38 into the interface between wafer surface and fixed abrasive article 41 which is attached to base 42. It is preferred that during planarization there be a consistent flow of the working liquid to the interface between the fixed abrasive article and the wafer surface. The liquid flow rate will depend in part upon the desired planarization criteria (removal rate, surface finish and planarity), the particular wafer construction and the exposed metal chemistry. The liquid flow rate typically ranges from about 10 to 500 milliliters/minute, preferably between about 25 to 250 milliliters/minute.

During the modifying process of invention, the fixed abrasive article is typically secured to subpad 43 which acts as a support pad for the fixed abrasive article. In part, the subpad provides both rigidity to allow the fixed abrasive article to effectively cut the exposed wafer surface and conformability such that the fixed abrasive article will uniformly conform to the exposed wafer surface. This conformability is important to achieve a desired surface finish across the entire exposed wafer surface. Thus, the choice of the particular subpad (i.e., the physical properties of the subpad) should correspond to the fixed abrasive article such that the fixed abrasive article provides the desired wafer surface characteristics (removal rate, surface finish and planarity).

The means used to attach the fixed abrasive article to the subpad preferably holds the fixed abrasive article flat and rigid during planarization. The preferred attachment means is a pressure sensitive adhesive (e.g., in the form of a film or tape). Pressure sensitive adhesives suitable for this purpose include those based on latex crepe, rosin, acrylic polymers and copolymers (e.g., polybutylacrylate and other polyacrylate esters), vinyl ethers (e.g., polyvinyl n-butyl ether), alkyd adhesives, rubber adhesives (e.g., natural rubber, synthetic rubber, chlorinated rubber), and mixtures thereof The pressure sensitive adhesive is preferably laminated or coated onto the back side of the fixed abrasive article using conventional techniques. Another type of pressure sensitive adhesive coating is further illustrated in U.S. Pat. No. 5,141,790, incorporated herein by reference.

The fixed abrasive article may also be secured to the subpad using a hook and loop type attachment system. The loop fabric may be on the back side of the fixed abrasive article and the hooks on the sub pad. Alternatively, the hooks may be on the back side of the fixed abrasive article and the loops on the subpad. Hook and loop type attachment systems are reported in U.S. Pat. Nos. 4,609,581; 5,254,194; 5,505,747; and PCT WO 95/19242.

Operating Conditions

Variables which affect the wafer processing include the selection of the appropriate contact pressure between the wafer surface and fixed abrasive article, type of liquid medium, relative speed and relative motion between the wafer surface and the fixed abrasive article, and the flow rate of the liquid medium. These variables are interdependent, and are selected based upon the individual wafer surface being processed.

In general, since there can be numerous process steps for a single semiconductor wafer, the semiconductor fabrication industry expects that the CMP process will provide a relatively high removal rate of material. The material removal rate should be at least 100 Angstroms per minute, preferably at least 500 Angstroms per minute, more preferably at least 1000 Angstroms per minute, and most preferably at least 1500 Angstroms per minute. In some instances, it may be desirable for the removal rate to be as high as at least 2000 Angstroms per minute, and even 3000 or 4000 Angstroms per minute. The removal rate of the fixed abrasive article may vary depending upon the machine conditions and the type of wafer surface being processed.

However, although it is generally desirable to have a high removal rate, the removal rate must be selected such that it does not compromise the desired surface finish and/or topography of the wafer surface.

The surface finish of the wafer may be evaluated by known methods. One preferred method is to measure the Rt value of the wafer surface which provides a measure of "roughness" and may indicate scratches or other surface defects. See, for example, Chapter 2, RST PLUS Technical Reference Manual, Wyko Corp., Tucson, Ariz. The wafer surface is preferably modified to yield an Rt value of no greater than about 3000 Angstroms, more preferably no greater than about 1000 Angstroms, and even more preferably no greater than about 500 Angstroms.

Rt is typically measured using an interferometer such as a Wyko RST PLUS Interferometer, purchased from Wyko Corp., or a TENCOR profilometer. Scratch and defect free surfaces are highly desirable.

The interface pressure between the fixed abrasive article and wafer surface (i.e., the contact pressure) is typically less than about 30 psi, preferably less than about 25 psi, more preferably less than about 15 psi. It has been discovered that the fixed abrasive article used in the method according to the invention provides a good removal rate at an exemplified interface pressure. Also, two or more processing conditions within a planarization process may be used. For example, a first processing segment may comprise a higher interface pressure than a second processing segment. Rotation and translational speeds of the wafer and/or the fixed abrasive article also may be varied during the planarization process.

Wafer surface processing is preferably conducted in the presence of a working liquid, which is selected based upon the composition of the wafer surface. In some applications, the working liquid typically comprises water, this water may be tap water, distilled water or deionized water. The working liquid may also contain chemicals designed to modify or improve the polishing performance. Such chemicals can include acids, bases, oxidizers or reducing agents. A preferred working liquid for polishing silicon oxide wafer surfaces is an aqueous base at a pH of 11–11.5. The wafer surfaces to be processed may include interlayer dielectric materials such as polycrystalline silicon, thermal oxide, doped and undoped oxides. Examples of interlayer dielectric materials commonly modified using Cow include silicon dioxide and silicon dioxide which is doped with boron and/or phosphorous. An additional type of interlayer dielectric material is a silicon dioxide into which fluorine has been introduced during deposition. Examples of metals which are commonly modified using CMP include tungsten, aluminum, copper, and mixtures and alloys of these metals.

The working liquid aids processing in combination with the fixed abrasive article through a chemical mechanical polishing process. During the chemical portion of polishing, the working liquid may react with the outer or exposed wafer surface. Then during the mechanical portion of processing, the fixed abrasive article may remove this reaction product.

The working liquid may also contain additives such as surfactants, wetting agents, buffers, rust inhibitors, lubricants, soaps, and the like. These additives are chosen to provide the desired benefit without damaging the underlying semiconductor wafer surface. A lubricant, for example, may be included in the working liquid for the purpose of reducing friction between the fixed abrasive article and the semiconductor wafer surface during planarization. At least one fluorochemical agent may be dispersed in a working liquid which becomes associated with the abrasive article during the surface modification process. The addition of the fluorochemical agent to a working liquid could allow for continual renewal of the fluorochemical to the abrasive composite during the surface modification process.

Inorganic particulates may also be included in the working liquid. These inorganic particulates may aid in the removal rate. Examples of such inorganic particulates include: silica, zirconia, calcium carbonate, chromia, ceria, cerium salts (e.g., cerium nitrate), garnet, silicates and titanium dioxide. The average particle size of these inorganic particulates should be less than about 1,000 Angstroms, preferably less than about 500 Angstroms and more preferably less than about 250 Angstroms. The addition of fluorochemical agent to the working liquid could allow for continual renewal of the fluorochemical at the abrasive composite during the surface modification process.

Although particulates may be added to the working liquid, the preferred working liquid is substantially free of inorganic particulates, e.g., loose abrasive particles which are not associated with the fixed abrasive article. Preferably, the working liquid contains less than 1% by weight, preferably less than 0.1% by weight and more preferably is essentially free of inorganic particulates.

The amount of the working liquid is preferably sufficient to aid in the removal of metal, metal oxide, inorganic metal oxides, or silicon dioxide deposits from the surface. In many instances, there is sufficient liquid from the basic working liquid and/or the chemical etchant. However, in some instances it is preferred to have second liquid present at the planarization interface in addition to the first working liquid. This second liquid may be the same as the liquid from the first liquid, or it may be different.

The ability of a number of fixed abrasive articles to remove metal from a wafer surface may be test procedures reported in Ser. No. 08/846,726 (Kaisaki), now abandoned, incorporated herein by reference.

EXAMPLES

The following non-limiting examples will further illustrate the invention. All parts, percentages, ratios, etc., in the examples are by weight unless otherwise indicated. The following abbreviations listed in Table 1 are used throughout.

TABLE 1

| Designation | Material |
|---|---|
| TMPTA | Trimethylolpropane triacrylate commercially available from Sartomer, Exton, PA. under the trade designation "Sartomer 351". |
| HDDA | Hexanediol diacrylate commercially available from Sartomer, Exton, PA. under the trade designation "Sartomer 238". |
| SANTICIZER 278 | Alkyl benzyl phthalate plasticizer commercially available from Monsanto, St. Louis, MO. |
| LUCIRIN 8893X | 2,4,6-Trimethylbenzoyl-diphenyl-phosphine oxide liquid photoinitiator commercially available from BASF, Charlotte, NC. |
| CEO | Ceria abrasive particles having an average particle size of about 0.5 micrometer, commercially available from Rhone Poulenc. |
| KR-TTS | An isopropyl triisostearoyl titanate coupling agent commercially available from Kenrich Petrochemicals Inc., Bayonne, NJ. |
| LUCIRIN LR8893 | 2,4,6-Trimethylbenzoyl-diphenyl-phosphine oxide liquid photoinitiator commercially available from BASF, Charlotte, NC. |
| CAL | A calcium carbonate filler having an average particle size of about 4.6 micrometers, commercially available from Specialty Minerals, New York, New York under the trade designation "USP-EX-HEAVY". |
| CAL-M | A calcium carbonate filler having an average particle size of about 2.6 micrometers, commercially available from Specialty Minerals, New York, New York under the trade designation "USP-MEDIUM" |
| CAL-MM | A calcium carbonate filler having an average particle size of about 0.07 micrometers, commercially available from Specialty Minerals, New York, New York under the trade designation "MULTIFLEX-MM" |
| KRYTOX 1514 | A perfluoropolyether commercially available from E.I. DuPont, Wilmington, DE. |
| FLUORAD FX-13 | Fluorochemical monoacrylate commercially available from Minnesota Mining and Manufacturing Co., St. Paul, MN. |
| FP-4 | ICI Americas, Inc., Wilmington, DE |
| PPF | A 76 micrometer thick (3 ml thick) polyester film containing an ethylene acrylic acid co-polymer primer on the front surface. |
| SCOTCH 476 MP | Scotch 467 MP Hi Performance Adhesive is a pressure sensitive tape manufactured by 3M, St. Paul, MN. |
| FC-DA | Fluorochemical diacrylate having the structure $C_8F_{17}SO_2N(C_2H_4OCOCH = CH_2)_2$ |
| FLUORINERT FC 72 | 3M, St. Paul, MN. |
| SILANE | The chemical $C_8F_{17}SO_2N(Et)CH_2CH_2CH_2Si(OMe)_3$ described in U.S. Pat. No. 5,527,415 |
| SCOTCH #7963 MP | A pressure sensitive adhesive commercially available from the 3M, St. Paul, MN. |

The following general procedures, General Procedure I and General Procedure II, were used to make the shaped fixed abrasive articles used in Examples 1 through 12.

General Procedure I For Making A Fixed Abrasive Article

First, an abrasive slurry, comprising a binder precursor, was prepared by thoroughly mixing the raw materials as listed in the examples in a high shear mixer.

The fixed abrasive article was made using a polypropylene production tool that comprised a series of cavities with specified dimensions arranged in a predetermined order or array. The production tool was essentially the inverse of the desired shape, dimensions and arrangement of the abrasive composites. The production tool was unwound from a winder. The abrasive slurry was coated at room temperature and applied into the cavities of the production tool using a vacuum slot die coater. Next, a PPF backing containing an ethylene acrylic acid co-polymer on the front surface was brought into contact with the abrasive slurry coated production tool such that the abrasive slurry wetted the front surface of the backing. Afterwards, ultraviolet light radiation was transmitted through the PPF backing and into the abrasive slurry. Two different ultraviolet lamps were used in series. The first UV lamp was a Fusion System ultraviolet light that used a "V" bulb and operated at 236.2 Watts/cm (600 Watts/inch). The second was an ATEK ultraviolet lamp that used a medium pressure mercury bulb and operated at 157.5 Watts/cm (400 Watts/inch). Upon exposure to the ultraviolet light, the binder precursor was converted into a binder and the abrasive slurry was converted into an abrasive composite. Then, the production tool was removed from the abrasive composite/backing and the production tool was rewound. Following this, the abrasive composite/backing, which formed the fixed abrasive article, was wound upon a core. This process was a continuous process that operated at between about 4.6 to 7.6 meters/minute (15 to 25 feet/minute).

To prepare the fixed abrasive article for testing, the fixed abrasive article was attached to pressure sensitive adhesive tape. A circular test sample was die cut for testing.

General Procedure H For Making A Fixed Abrasive Article

General Procedure II was generally the same as General Procedure I, except that the wetted PPF backing, abrasive slurry and production tool were secured to a metal carrier plate, was passed through a bench top laboratory laminator commercially available from Chem Instruments, Model #001998. The article was continuously fed between two rubber rollers at a pressure of about 280 Pa (40 psi) and a speed of 2 to 7. The fixed abrasive article was cured by passing the tool together with the backing and binder precursor under two iron doped lamps commercially available from American Ultraviolet Company, that operated at about 157.5 Watts/cm (400 Watts/inch). The radiation passed through the film backing. The speed was about 10.2 meters/minute (35 feet/minute) and the sample was passed through two times.

To prepare the fixed abrasive article for testing, the fixed abrasive article was laminated to pressure sensitive adhesive tape. A circular test sample was die cut for testing.

Pattern #1

A production tool was made by casting polypropylene material on a metal master tool having a casting surface comprised of a collection of adjacent truncated pyramids. The resulting production tool contained cavities that were in the shape of truncated pyramids. The height of each truncated pyramid was about 80 micrometers, the base was about 178 micrometers per side and the top was about 51 micrometers per side. The pyramids were formed in a square array with a center to center spacing of 230 microns.

The following general procedures, Procedures I and II for determining the removal rate of the sample articles are described below.

Procedure I For Determining The Removal Rate Of A Fixed Abrasive Article

The test procedure was performed on a prototype chemical mechanical polisher consisting of a 20 inch diameter rotating platen to which a Q1400 polishing pad, manufactured by Rodel, Inc. of Newark Del., was attached with pressure sensitive adhesive. The fixed abrasive pad to be tested was laminated onto the top of the Q1400 polishing pad with a layer of pressure sensitive adhesive. The wafers used were 200 mm diameter sheet film thermal oxide wafers; the silicon oxide layer was approximately 1 micron thick and grown by thermal oxidation.

The wafers to be polished were placed into a rotating carrier head which pressed the wafer onto the fixed abrasive pad with adjustable pressure. The wafer was held in the head by a ⅜" wide retaining ring made of Delrin thermoplastic. The retaining ring was pressed onto the fixed abrasive pad with adjustable pressure.

Polishing was accomplished by flooding the pad with aqueous potassium hydroxide solution at pH 11.3 supplied at a rate of 150 mL/minute throughout the polishing cycle. The wafers were polished on one side at a platen rotation rate of 31 rpm and a carrier head rotation rate of 33 rpm. The wafers were pressed onto the fixed abrasive pad with a pressure of 6 psi, and the retaining ring was pressed onto the pad with a pressure of 11 psi. During the polishing cycle, the carrier head was swept back and forth slowly along the radius of the platen so that the inner edge of the retaining ring surrounding the wafer came essentially to the center of the pad on the innermost portion of the sweep, and the outer edge of the retaining ring surrounding the wafer came essentially to the outer edge of the platen on the outermost portion of the sweep.

Average removal rate for each wafer was determined by measuring the difference between the starting thickness of the oxide layer and the final thickness of the oxide layer at 49 points over the surface of the wafer using a PROMETRIX SM200 instrument, manufactured by Tencor of Mountainview, Calif. The values reported are the average removal rate (in angstroms of oxide removed per minute) for 10 wafers.

Procedure II For Determining The Removal Rate Of A Fixed Abrasive Article

The workpieces for this test procedure were 100 mm diameter sheet film thermal oxide wafers. The deposited silicon dioxide thickness was between about 7,000 to 20,000 Angstroms, as measured by using commercially available measuring device such as #RR/FTM RESIST manufactured by Rudolph, Inc. of Fairfield, N.J. The silicon dioxide thickness was measured five times at different locations within the plane parallel to the major exposed surface of the wafer.

The test machine was a modified Strausbaugh Lapping Machine, Model 6Y-1 similar to the apparatus depicted in FIG. 4. The workpiece was assembled into a retaining ring, commercially available from Rodel of Newark, Del. A pressure sensitive adhesive, SCOTCH 7963MP, was laminated to the back side of the fixed abrasive article. This pressure sensitive adhesive enabled the fixed abrasive article to be secured to a polyester film disc, 40.6 cm (16 inches) in diameter, between the abrasive sample disc and the first support pad. The first support pad was a polyurethane pad commercially available from Rodel of Newark, Del. under the trade designation "IC1000". A second support pad, under the trade designation "SUBA IV", manufactured by Rodel of newark, Del., was placed underneath the first support pad. The second support pad was attached onto the platen of the lapping machine. Each support pad had a diameter of about 30.5 cm (12 inches).

The head holding the workpiece was caused to rotate at about 100 rpm before it was brought into contact with the abrasive disc. The workpiece moved through a 31 mm arc starting 13 mm from the edge of the abrasive disc with a nine second periodicity. The abrasive disc was rotated at about 67 to 70 rpm. The workpiece and abrasive disc each rotated in a clockwise manner as viewed from above. Both the abrasive disc and workpiece were rotated first and then brought into contact with a downward load or force of about 16.2 kg (36 lbs). At the disc and the workpiece interface was pumped a potassium hydroxide solution (0.25% by wt. KOH in deionized water) which had a pH about 11.5. The flow rate of the potassium hydroxide solution was 80 mL/minute. The abrasive disc was used to treat the workpiece for a two minute cycle. After the treatment ended, the workpiece was rinsed with deionized water and dried.

Next, the workpiece was tested for removal rate. The removal rate was measured by determining the oxide film thickness in the same locations, as measured prior to treatment using the same machine. The difference between the workpiece thickness prior to treatment and the thickness after treatment is referred to in the following tables as the "removal rate." The removal rate for ten workpieces was averaged to determine an average removal rate in units of Angstroms per minute.

Examples 1 and 2

This set of examples was prepared by the procedure described in General Procedure I for Making A Fixed Abrasive Article using pattern #1. The articles of examples 1 and 2 were made of components listed in Table 2.

TABLE 2

| MATERIALS | | |
|---|---|---|
| Component | Example 1 Wt. % | Example 2 Wt. % |
| TMPTA | 2.17 | 1.99 |
| HDDA | 6.50 | 5.96 |
| SANTICIZER 278 | 8.67 | 9.71 |
| FP4 | 0.53 | 0.49 |
| LUCIRIN 8893x | 0.55 | 0.56 |
| CEO | 81.58 | 74.00 |
| Talc (Stellar 410) | | 7.30 |

A fluorochemical agent was applied to the surfaces of the fixed abrasive articles of examples 1 and 2. The agent was a crosslinkable fluorochemical copolymer. It was prepared by mixing 6.0 grams $C_8F_{17}SO_2N(Me)C_2H_4OCOCH{=}CH_2$, 6.0 grams $C_nF_{2n+1}C_2H_4OCOCH{=}CH_2$ (n=8 and 10, average n=9.2), 12.0 grams 3-methacryloxypropyl trimethoxysilane, 0.5 grams 3-mercaptopropyl trimethoxysilane, 0.10 grams azo(bisisobutyronitrile) and 40 grams ethyl acetate in a container. This mixture was purged at a rate of one liter per minute nitrogen for 35 seconds and the container holding the compositions was sealed and heated at 55° C. and rotated in a water bath for 20 hours. Two such containers were prepared. Approximately 1.5g samples from each container were evaporated at 105° C. for 2 hours and the residues were weighed, showing 31.2% solid of the first polymer composition and 31.4% solid of the second polymer composition. These were pooled and 40.0 g of the pooled composition was mixed with 248 grams ethyl acetate and 2.5 grams of a solution of 10% $C_7F_{15}CO_2H$ (HOESCHT) in ethyl acetate. The resulting mixture was applied with a paintbrush to a surface of a fixed abrasive article at a rate of about 4.5 milligrams per 25 sq. cm. The fluorochemical-polymer coatings were allowed to cured for about 5 days at room temperature and humidity.

The removal rates of the resulting fixed abrasive articles were determined by Procedure I For Determining The Removal Rate Of A Fixed Abrasive Article. The test results are in Table 3.

TABLE 3

| Articles | Fluorochemical | Removal rate ($A^0$/min) | Noise Level |
|---|---|---|---|
| Example 1 | No Fluorochemical Agent | 793 | 3 |
| Example 1 | Fluorochemical Agent | 2121 | 1 |
| Example 2 | No Fluorochemical Agent | 1373 | 4 |
| Example 2 | Fluorochemical Agent | 2872 | 1 |

Noise levels were measured during the surface modification process by a single machine operator who was easily able to detect the difference in sound between the processes without the use of electronic measuring devices. A noise level of 6 reflects sound capable of damaging the human ear and a noise level of 1 reflects sound barely detectable by the human ear. The association of a fluorochemical agent with a fixed abrasive article decreases the sound created during the modification process when a surface of the fixed abrasive article contacts a surface of the semiconductor wafer. In addition, the removal rates of the uncoated fixed abrasive articles were lower than the removal rates of coated fixed abrasive articles. The fluorochemical agent improved the removal rates of the fixed abrasive articles of Examples 1 and 2.

Examples 3 through 5

This set of examples was prepared by the procedure described in General Procedure I For Making A Fixed Abrasive Article using Pattern #1. The article of example 3 was made of components listed in Table 4.

TABLE 4

| MATERIALS | |
|---|---|
| Component | Example 3 % |
| TMPTA | 3.09 |
| HDDA | 9.26 |
| SANTICIZER 278 | 15.08 |
| KR-TTS | 1.81 |
| LUCIRIN LR8893 | 0.88 |
| CEO | 45.25 |
| CAL | 22.09 |
| CAL-M | 2.03 |
| CAL-MM | 0.51 |

The article of example 4 was made of the same components as the article of example 3, however, the surface of the article of example 4 was coated with a solution comprising an unreactive fluorochemical oil known as "KRYTOX" 1514.

The solution was prepared by combining 2% w/w of "KRYTOX" 1514 in "FLUORINERT" FC 72 and approximately 50 grams of this 2% solution was sprayed onto the surface of the abrasive article of example 4. The article was allowed to air dry overnight.

The article of example 5 was made of the same components as the article of Example 3; however, the surface of the article of example 5 was coated with a fluorochemical silane (having the structure $C_8F_{17}SO_2N(Et)CH_2CH_2CH_2Si(OMe)$ $_3$, as described in U.S. Pat. No. 5,274,159). A 2% w/w solution of the fluorochemical silane in "FLUORINERT" FC 72 was prepared. Approximately 50 grams of this 2% solution was sprayed onto the surface of the article of Example 5. The article was allowed to air dry overnight.

The removal rates of the resulting fixed abrasive articles of examples 3, 4, and 5 were tested according to Procedure I For Determining The Removal Rate Of A Fixed Abrasive Article. The test results are in Table 5.

TABLE 5

| Articles | Fluorochemical | Removal rate (A/min) | Noise Level |
|---|---|---|---|
| Example 3 | Control-no Fluorochemical Agent | 801 | 3 |
| Example 4 | Coated with 2% KRYTOX 1514 | 1937 | 1 |
| Example 5 | Coated with 2% Silane | 2660 | 2 |

The noise level values are defined under the section labeled examples 1 and 2. The surface modification process using fixed abrasive articles of examples 4 and 5 comprising a fluorochemical agent made less noise than the surface modification process using the fixed abrasive articles free of fluorochemical agents of example 3. Also, fixed abrasive particles comprising fluorochemical agents had improved removal rates compared to fixed abrasive article free of fluorochemical agents.

Examples 6 through 8

This set of examples was prepared by the procedure described in General Procedure II For Making A Fixed Abrasive Article using Pattern #1. The amount of materials for the articles of each example are listed in Table 6.

TABLE 6

MATERIALS

| Component | Example 6 | Example 7 | Example 8 |
|---|---|---|---|
| TMPTA | 6.15 | 6.15 | 6.14 |
| HDDA | 18.43 | 18.42 | 18.42 |
| SANTICIZER 278 | 30.03 | 30.01 | 30.02 |
| KR-TTS | 3.59 | 3.60 | 3.68 |
| LUCERIN 8893 | 1.80 | 1.87 | 1.81 |
| CEO | 90.0 | 90.0 | |
| CEO Treated with KRYTOX 1514 | | | 99.07 |
| CAL | 43.86 | 43.95 | 44.07 |
| CAL-M | 4.07 | 4.11 | 4.10 |
| CAL-MM | 1.06 | 1.03 | 1.07 |
| KRYTOX 1514 | | 8.80 | |

The article of example 6 was free of fluorochemical agents. The article of example 7 contained "KRYTOX" 1514 dispersed within its binder and the article of example 8 contained abrasive particles associated with "KRYTOX" 1514. The article of example 8 was prepared by taking 90 parts by wt of the CEO particles and placing them in a solution comprising 9 parts of "KRYTOX" 1514 in 100 parts of "FLUORINERT" FC 72. After mixing, the composition was placed in a vacuum. The dried, coated CEO particles were then combined with a binder to form the fixed abrasive article of example 8. The removal rate of the resulting articles were tested according to Procedure II For Determining The Removal Rate Of A Fixed Abrasive Article. The test results are in Table 7.

TABLE 7

| Examples | Fluorochemical: KRYTOX 1514 | Removal rate (A/min) |
|---|---|---|
| 6 | Control - No Fluorochemical Agents | 1070 |
| 7 | Fluorochemical dispersed in binder | 1240 |
| 8 | Abrasive particles pretreated with Fluorochemical | 1340 |

The articles of examples 7 and 8 had increased removal rates compared to the article of example 6 free of fluorochemical agents in its binder.

Examples 9 through 12

This set of examples was prepared by the procedure described in General Procedure II For Making A Fixed Abrasive Article using Pattern #1. The articles of examples 9 and 11 contain reactive fluorochemical agents that are involved in the binder polymer polymerization process. The article of example 9 comprises a fluorochemical difunctional acrylate and the article of example 11 comprises a fluorochemical monofunctional acrylate. The concentrations of the acrylates (FC-DA and FLUORAD FX-13) as well as other materials are listed in Table 8. The concentration of materials of the articles of examples 9 and 10 were chosen so that both articles had equivalent concentrations of acrylic functional groups and equivalent ratio of mineral to organic binder. Also, the concentrations of the materials of the articles of examples 11 and 12 were chosen so that both articles had equivalent concentrations of acrylic functional groups and equivalent ratio of mineral to organic binder.

TABLE 8

MATERIALS

| | Fluoro-difunctional Acrylate | | Fluoro-monofunctional Acrylate | |
|---|---|---|---|---|
| Component | Example 9 | Example 10 (Control) | Example 11 | Example 12 (Control) |
| TMPTA | 20 g | 9.2 g | 50 g | 13.0 g |
| FLUORAD FX-13 | | | 26.81 g | |
| SANTICIZER-278 | 50 g | 80 g | 30 g | 35.0 g |
| FP-4 | 3.0 g | 2.5 g | 3.5 g | 2.5 g |
| LUCIRIN 8893 | 3.2 g | 3.2 g | 3.2 g | 3.2 g |
| CEO | 400 g | 400 g | 400 g | 350 g |
| HDDA | | 27.60 g | | 39.0 g |
| FC-DA | 30 g | | | |

The fixed abrasive articles of Examples 9 through 12 were made according to the General Procedure II For Making A Fixed Abrasive Article using Pattern #1. The removal rates of the fixed abrasive articles of the Examples were determined by Procedure II For Determining The Removal Rate Of A Fixed Abrasive Article. The test results are in Table 9.

TABLE 9

| Example | Fluorochemical | Meg/gram | $A^0$/Min |
|---|---|---|---|
| 9 | Fluorochemical Diacrylate | 0.58 | 2610 |
| 10 | No Fluorochemical | 0.58 | 2470 |

TABLE 9-continued

| Example | Fluorochemical | Meg/gram | A°/Min |
|---|---|---|---|
| 11 | Fluorochemical Monoacrylate | 1.07 | 1310 |
| 12 | No Fluorochemical | 1.08 | 970 |

The articles of examples 9 and 11 had increased removal rates compared to the untreated articles of examples 10 and 12, respectively. Examples 9 and 11 appear to promote a CMP process with a consistent surface removal rate. When the first two wafers in each series were omitted, the average removal rate and standard deviation were: Example 9: 2606±64 A°/min; Example 10: 2466±448 A°/min; Example 11: 1379±75 A°/min; Example 12: 966±66 A°/min.

We claim:

1. A fixed abrasive article comprising a fluorochemical agent for the modification of a surface of a semiconductor wafer, comprising:

(a) three-dimensional abrasive composites, each composite comprising a plurality of abrasive particles fixed and dispersed in a binder providing a textured exposed major surface of a fixed abrasive article;

(b) at least one fluorochemical agent associated with the abrasive composites; and (c) a backing coextensive with the abrasive composites.

2. The article of claim 1, wherein at least one fluorochemical agent is selected from the group consisting of fluorochemical acrylates, fluorochemical methacrylates, fluorochemical epoxies, fluorochemical silanes, fluorochemical isocyanates, fluorochemical carboxylic acids and their salts and amides, fluorochemical phosphoric acids and their salts and amides, fluorochemical sulfonic acids and their salts and amides, fluorochemical phosphate esters, fluorochemical phosphate esters, fluorochemical alcohols, fluorochemical polyether oils, fluorochemical alkane waxes, fluorochemical ethers, fluorochemical esters, fluorochemical urethanes, fluorochemical amides, fluorochemical thermoplastics; fluorochemical thermoplastic copolymers, and fluorochemical elastomers.

3. The article of claim 1 wherein at least the binder of the abrasive composite is associated with at least one fluorochemical agent.

4. The article of claim 3, wherein the fluorochemical agent is a fluorochemical polyether oil.

5. The article of claim 3, wherein the fluorochemical agent is a fluorochemical monofunctional acrylate.

6. The article of claim 3, wherein the fluorochemical agent is a fluorochemical difunctional acrylate.

7. The article of claim 1 wherein at least the abrasive particles of the abrasive composite is associated with at least one fluorochemical agent.

8. The article of claim 7, wherein the fluorochemical agent is a fluorochemical polyether oil.

9. The article of claim 1, wherein at least the surface of the abrasive composite is associated with at least one fluorochemical agent.

10. The article of claim 9, wherein the fluorochemical agent is a polymer comprising $C_nF_{2n+1}C_2H_4OCOCH{=}CH_2$ (n=5–12) and $C_8F_{17}SO_2N(Me)C_2HOCOCH{=}CH_2$.

11. The article of claim 9, wherein the fluorochemical agent is a fluorochemical polyether oil.

12. The article of claim 9, wherein the fluorochemical agent is a fluorochemical silane.

13. The article of claim 12, wherein the fluorochemical silane is $C_8F_{17}SO_2N(Et)CH_2CH_2CH_2Si(OMe)_3$.

14. The article of claim 1, wherein the abrasive composite further comprises a filler.

15. The article of claim 14, wherein at least the filler of the abrasive composite is associated with the at least one fluorochemical agent.

16. An abrasive construction, comprising:

(a) a fixed abrasive article comprising three-dimensional abrasive composites, each composite comprising a plurality of abrasive particles fixed and dispersed in a binder, wherein the abrasive composites provide a textured exposed major surface of the fixed abrasive article and there is at least one fluorochemical agent associated with the abrasive composites;

(b) at least one resilient element generally coextensive with the fixed abrasive article; and (c) at least one rigid element generally coextensive with and interposed between the resilient element and the fixed abrasive article, wherein the rigid element has a Young's Modulus greater than that of the resilient element.

17. A method of modifying an exposed surface of a semiconductor wafer, comprising the steps of:

(a) contacting the surface with a fixed abrasive article comprising three-dimensional abrasive composites, each composite comprising a plurality of abrasive particles fixed and dispersed in a binder wherein the abrasive composites are associated with at least one fluorochemical agent and are coextensive with a backing; and (b) moving the wafer and the abrasive article relative to each other to modify the surface of the wafer.

18. The method of claim 17, wherein the at least one fluorochemical agent is dispersed in a working liquid prior to the fluorochemical's association with the abrasive composite.

19. The method of claim 17, wherein the surface of the wafer comprises metal.

20. The method of claim 19, wherein the metal is selected from the group consisting of gold, silver, tungsten, aluminum, copper, or mixtures thereof.

21. The method of claim 17, wherein the surface of the wafer comprises inorganic metal oxide.

22. The method of claim 21, wherein the inorganic metal oxide comprises silicon dioxide, doped silicon dioxide, or mixtures thereof.

23. The method of claim 22, wherein the doped silicon dioxide comprises boron, phosphorous, or mixtures thereof.

24. The method of claim 21, wherein the inorganic metal oxide is a fluorine modified silicon dioxide.

25. The method of claim 17, wherein the surface of the wafer comprises organic polymeric material.

26. The method of claim 25, wherein the organic polymeric material is polyimide.

27. A method of modifying an exposed surface of a semiconductor wafer, comprising the steps of:

(a) contacting the surface with a fixed abrasive article three-dimensional abrasive composites, each composite comprising a plurality of abrasive particles fixed and dispersed in a binder wherein the abrasive composites are associated with at least one fluorochemical and are coextensive with a backing; and (b) moving the wafer and the abrasive article relative to each other to modify the surface of the wafer, wherein the noise generated from the modification method is minimized by the association of the fluorochemical agent to the abrasive composite.

28. The method according to claim 27, wherein the at least one fluorochemical agent is a component of a working liquid.

* * * * *

UNITED STATES PATENT AND TRADEMARK OFFICE

CERTIFICATE OF CORRECTION

PATENT NO.: 6,121,143

DATED: September 19, 2000

INVENTOR(S): Robert P. Messner, Carl R. Kessel and George G. Moore

It is certified that error appears in the above-identified patent and that said Letters Patent is hereby corrected as shown below:

In column 33, line 59, "(n = 5-12) and $C_8F_{17}SO_2N(Me)C_2HOCOCH{=}CH_2$." should read "(n = 5-12) and $C_8F_{17}SO_2N(Me)C_2H_4OCOCH{=}CH_2$".

Signed and Sealed this

Fifteenth Day of May, 2001

*Attest:*

Nicholas P. Godici

NICHOLAS P. GODICI

*Attesting Officer*

*Acting Director of the United States Patent and Trademark Office*